US012084879B2

(12) United States Patent
Yang et al.

(10) Patent No.: US 12,084,879 B2
(45) Date of Patent: Sep. 10, 2024

(54) COLLAPSIBLE CANOPY WITH REINFORCEMENT BARS

(71) Applicants: Shengyong Yang, Shanghai (CN); Jing Bian, Shanghai (CN)

(72) Inventors: Shengyong Yang, Shanghai (CN); Jing Bian, Shanghai (CN)

( * ) Notice: Subject to any disclaimer, the term of this patent is extended or adjusted under 35 U.S.C. 154(b) by 0 days.

(21) Appl. No.: 17/716,126

(22) Filed: Apr. 8, 2022

(65) Prior Publication Data

US 2022/0228397 A1 Jul. 21, 2022

Related U.S. Application Data

(63) Continuation-in-part of application No. 16/188,273, filed on Nov. 12, 2018, now Pat. No. 11,299,906, which is a continuation-in-part of application No. 16/012,076, filed on Jun. 19, 2018, now Pat. No. 10,597,897, which is a continuation-in-part of application No. 15/925,314, filed on Mar. 19, 2018, now Pat. No. 10,669,738, which is a (Continued)

(51) Int. Cl.

| | |
|---|---|
| ***E04H 15/48*** | (2006.01) |
| ***E04H 15/50*** | (2006.01) |
| ***E04H 15/52*** | (2006.01) |
| ***E04H 15/54*** | (2006.01) |
| ***E04H 15/58*** | (2006.01) |

(52) U.S. Cl.

CPC ..... *E04H 15/58* (2013.01); *E04H 15/48* (2013.01); *E04H 15/52* (2013.01); *E04H 15/54* (2013.01)

(58) Field of Classification Search

CPC ..... E04H 15/58; E04H 15/48; E04H 15/52; E04H 15/54; E04H 15/50

USPC ..... 135/117, 131, 135, 145, 149

See application file for complete search history.

(56) References Cited

U.S. PATENT DOCUMENTS 1,846,011 A * 2/1932 Adams ..... E04H 15/48 135/117
2,182,283 A * 12/1939 Curtis ..... E04H 15/48 135/117

(Continued)

FOREIGN PATENT DOCUMENTS

CN 2456940 Y * 10/2001
DE 202020101971 U1 * 6/2020 ..... E04H 15/18
EP 1808556 A2 * 7/2007 ..... E04H 15/50

*Primary Examiner* — Robert Canfield

(74) *Attorney, Agent, or Firm* — Schmeiser, Olsen & Watts, LLP

(57) ABSTRACT

A collapsible canopy with reinforcement bars. The collapsible canopy has at least three supporting legs. An outer retractable unit is connected between each adjacent supporting leg. An inner retractable unit is connected to each supporting leg. Reinforcement bars are pivotally connected between the outer retractable units and the inner retractable units, the reinforcement bars function to maintain the shape of the collapsible canopy when the collapsible canopy is in a locked and unfolded position. The collapsible canopy further has a plurality of overhanging rods and cross bars, when said overhanging rod is in unfolded state, an inner end portion of the overhanging rod is connected to one of the supporting legs, each cross bar is connected between one of said outer retractable units and one of said inner retractable units, such that the overhanging rod is reinforced when said overhanging rod is in the unfolded state.

17 Claims, 37 Drawing Sheets

Related U.S. Application Data continuation-in-part of application No. 15/549,164, filed as application No. PCT/CN2016/091675 on Jul. 26, 2016, now Pat. No. 10,273,710.

(56) References Cited

U.S. PATENT DOCUMENTS 4,256,129 A * 3/1981 Gilsenan ..... E04H 15/50 135/98
4,558,713 A * 12/1985 Hagler ..... E04H 15/34 135/159
5,035,253 A * 7/1991 Bortles ..... E04H 15/50 135/117
6,336,465 B1 * 1/2002 Surrendi ..... E04H 15/28 135/147
6,708,707 B2 * 3/2004 Dotterweich ..... E04H 15/50 135/159
6,718,995 B2 * 4/2004 Dotterweich ..... E04H 15/50 135/117
7,055,538 B2 * 6/2006 Deng ..... E04H 15/50 135/117
7,836,908 B2 * 11/2010 Sy-Facunda ..... E04H 15/50 135/147
8,544,489 B2 * 10/2013 Choi ..... E04H 15/50 135/147
8,616,226 B2 * 12/2013 Ma ..... E04H 15/42 135/117
8,893,737 B2 * 11/2014 Yang ..... E04H 15/48 135/144
9,482,026 B2 * 11/2016 Ampoyo ..... E04H 15/505
9,528,292 B1 * 12/2016 Lovley, II ..... E04H 15/50
9,739,073 B2 * 8/2017 Huang ..... E04H 15/50
9,926,720 B2 * 3/2018 Huang ..... E04H 15/54
9,995,057 B2 * 6/2018 Wu ..... E04H 15/54
10,041,272 B2 * 8/2018 Choi ..... E04H 15/50
10,113,329 B2 * 10/2018 Choi ..... E04H 15/46
10,280,645 B1 * 5/2019 Yang ..... E04H 15/50
10,309,121 B2 * 6/2019 Choi ..... E04H 15/50
D854,107 S * 7/2019 Choi ..... D21/834
D859,564 S * 9/2019 Choi ..... D21/839
10,745,934 B2 * 8/2020 Choi ..... E04H 15/48
10,941,585 B2 * 3/2021 Sun ..... E04H 15/50
2002/0092555 A1 * 7/2002 Chen ..... E04H 15/50 135/144
2003/0172966 A1 * 9/2003 Dotterweich ..... E04H 15/50 135/131
2004/0020527 A1 * 2/2004 Deng ..... E04H 15/50 135/131
2004/0050412 A1 * 3/2004 Dotterweich ..... E04H 15/50 135/131
2005/0016573 A1 * 1/2005 Wu ..... E04H 15/48 135/98
2007/0051397 A1 * 3/2007 Choi ..... E04H 15/50 135/117
2008/0066795 A1 * 3/2008 Sy-Facunda ..... E04H 15/50 135/145
2009/0032079 A1 * 2/2009 Choi ..... E04H 15/50 135/144
2010/0051078 A1 * 3/2010 Sy-Facunda ..... E04H 15/58 135/117
2011/0073148 A1 * 3/2011 Choi ..... E04H 15/50 135/144
2011/0308559 A1 * 12/2011 Ma ..... E04H 15/38 135/122
2013/0284225 A1 * 10/2013 Holland ..... E04H 15/46 135/145
2014/0174491 A1 * 6/2014 Yang ..... E04H 15/48 135/144
2014/0261602 A1 * 9/2014 Ampoyo ..... E04H 15/505 135/139
2015/0376913 A1 * 12/2015 Choi ..... E04H 15/50 135/147
2016/0108639 A1 * 4/2016 Huang ..... E04H 15/50 135/144
2018/0080242 A1 * 3/2018 Choi ..... E04H 15/46
2018/0080243 A1 * 3/2018 Choi ..... E04H 15/50
2018/0106066 A1 * 4/2018 Choi ..... E04H 15/60
2018/0106067 A1 * 4/2018 Choi ..... E04H 15/46
2018/0106068 A1 * 4/2018 Choi ..... E04H 15/46
2018/0142493 A1 * 5/2018 Choi ..... E04H 15/50
2018/0298631 A1 * 10/2018 Yang ..... E04H 15/50
2019/0277053 A1 * 9/2019 Yang ..... E04H 15/48
2020/0071950 A1 * 3/2020 Yang ..... E04H 15/44
2020/0157838 A1 * 5/2020 Yuan ..... E04H 15/50
2020/0407999 A1 * 12/2020 Huang ..... E04H 15/50
2021/0301551 A1 * 9/2021 Baik ..... E04H 15/50
2022/0034118 A1 * 2/2022 Sun ..... E04H 15/50
2022/0412119 A1 * 12/2022 Tao ..... E04H 15/02

* cited by examiner

COLLAPSIBLE CANOPY WITH REINFORCEMENT BARS

The present disclosure relates to an outdoor product, in particular to a collapsible canopy. This application is a Continuation-in-Part (CIP) of U.S. application Ser. No. 16/188,273 filed on Nov. 12, 2018 (soon to issue as U.S. Pat. No. 11,299,906 on Apr. 12, 2022), which is CIP of U.S. application Ser. No. 16/012,076 filed on Jun. 19, 2018 (which issued as U.S. Pat. No. 10,597,897 on Mar. 24, 2020), which is a CIP of U.S. application Ser. No. 15/925,314 filed on Mar. 19, 2018 (which issued as U.S. Pat. No. 10,699,738 on Jun. 6, 2020), which is a CIP of U.S. application Ser. No. 15/549,164 filed on Aug. 6, 2017 (which issued as U.S. Pat. No. 10,273,710 on Apr. 30, 2019), which is National Stage Entry of PCT Application Serial No. PCT/CN2016/091675, filed on Jul. 26, 2016, of which all of the above are incorporated herein by reference.

BACKGROUND OF THE INVENTION

Collapsible canopies that are capable of being locked into an unfolded position are very popular in modern society. Generally, each collapsible canopy comprises a foldable collapsible canopy frame and a collapsible canopy fabric, the collapsible canopy frame consists of a roof frame and four or more supporting legs, the supporting legs are used for supporting the roof frame and are provided with a locking structure on each supporting leg respectively, the collapsible canopy fabric covers the roof frame and is used for sunshading, rain sheltering or wind sheltering. At present, the locking structure is generally a locking pin, and an unfolded state of the collapsible canopy is locked by way of respectively locking each supporting leg. However, this way has the following defects:

In a process where a collapsible canopy is unfolded or folded, a user needs to perform a locking operation or an unlocking operation on a locking mechanism of each supporting leg one by one when unfolding or folding the collapsible canopy. The operation is cumbersome, functional defects or improper operation of forcing unlocking can occur. Also, the unfolding or folding of the collapsible canopy needs cooperation of many people so that the collapsible canopy can be erected. In addition, in a process where the collapsible canopy is unfolded and is erected, stresses of stress points of a plurality of supporting legs are not uniform, thus it is very difficult to support the collapsible canopy at optimum points and consequently the supporting effect of the collapsible canopy is influenced. Damages to the collapsible canopy mostly occur at the supporting legs of the collapsible canopy, since positions of sliding blocks need to be fixed after the collapsible canopy is unfolded, and holes are formed in the supporting legs at the fixing positions of the sliding blocks for inserting locking pins. Holes in the supporting legs weakens the supporting strength of the supporting legs, and the supporting legs are usually damaged at the fixing positions of the sliding blocks and consequently the service life of the collapsible canopy is shortened.

It should also be noted that prior art collapsible canopies can be unstable if exposed to certain conditions. For example, FIG. 31 shows prior art canopy 895 covered in fabric. Wind force is blowing against the side of canopy 895. Unfortunately canopy 895 has no means to resist this external force and consequently its side is deformed due to the action of the wind force.

What is needed is collapsible canopy with a better locking mechanism and structural reinforcement to better resist deformation of shape.

SUMMARY OF THE INVENTION

The present invention provides a collapsible canopy with an improved locking mechanism. The collapsible canopy has at least three supporting legs. The collapsible canopy also has a central lock that is used for locking the collapsible canopy in an unfolded state and permits the collapsible canopy to be folded into a folded state when the central lock is unlocked. An outer retractable unit is connected between each adjacent supporting leg. An inner retractable unit having an inner end is connected between each supporting leg and the central lock. The inner end of the inner retractable unit is connected through the central lock. Reinforcement bars are pivotally connected between the outer retractable units and the inner retractable units, the reinforcement bars function to maintain the shape of the collapsible canopy when the collapsible canopy is in a locked and unfolded position.

DETAILED DESCRIPTION OF THE PREFERRED EMBODIMENTS

The present invention provides a collapsible canopy that utilizes a self-locking central lock to lock the canopy in an unfolded state for secure usage. The self-locking central lock is highly effective and reliable and is very resistant to corrosion and damage due to exposure and use. The present invention also shows the utilization of reinforcement bars to better maintain the shape of the canopy and to resist any force that may cause shape deformation. The below listed embodiments present collapsible canopies with various self-locking central locks and also shows the utilization of reinforcement bars.

Preferred Embodiment with Stop Pole Connected to Center Top Cap

Figure 1:
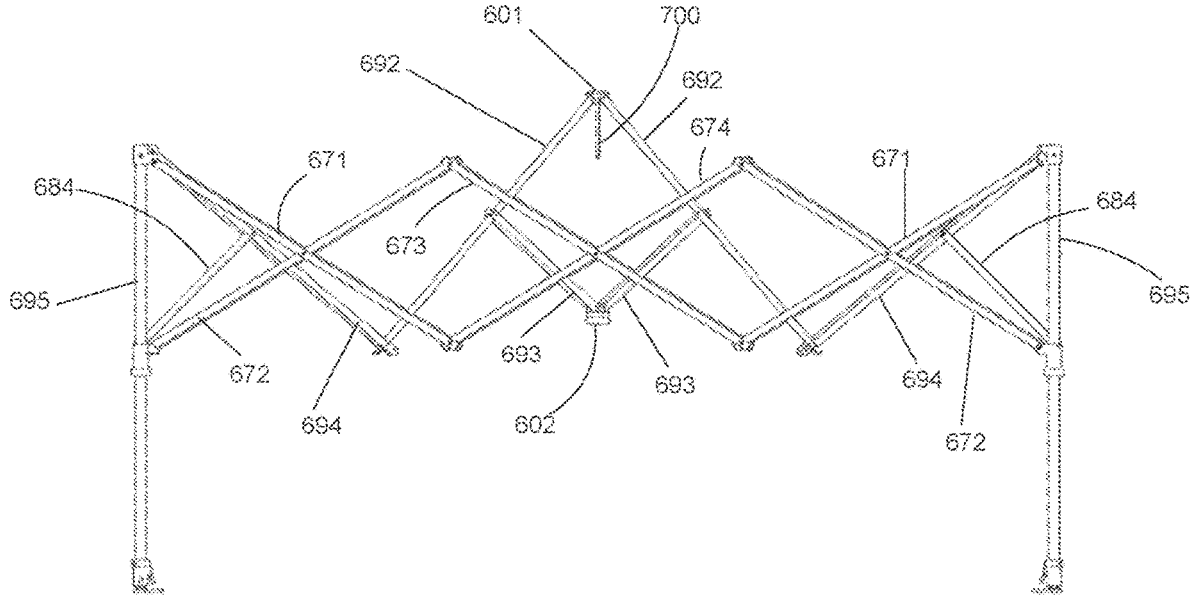
FIGS. 1-9 show a preferred embodiment of the present invention utilizing a stop pole as a stopping device.
Figure 2:
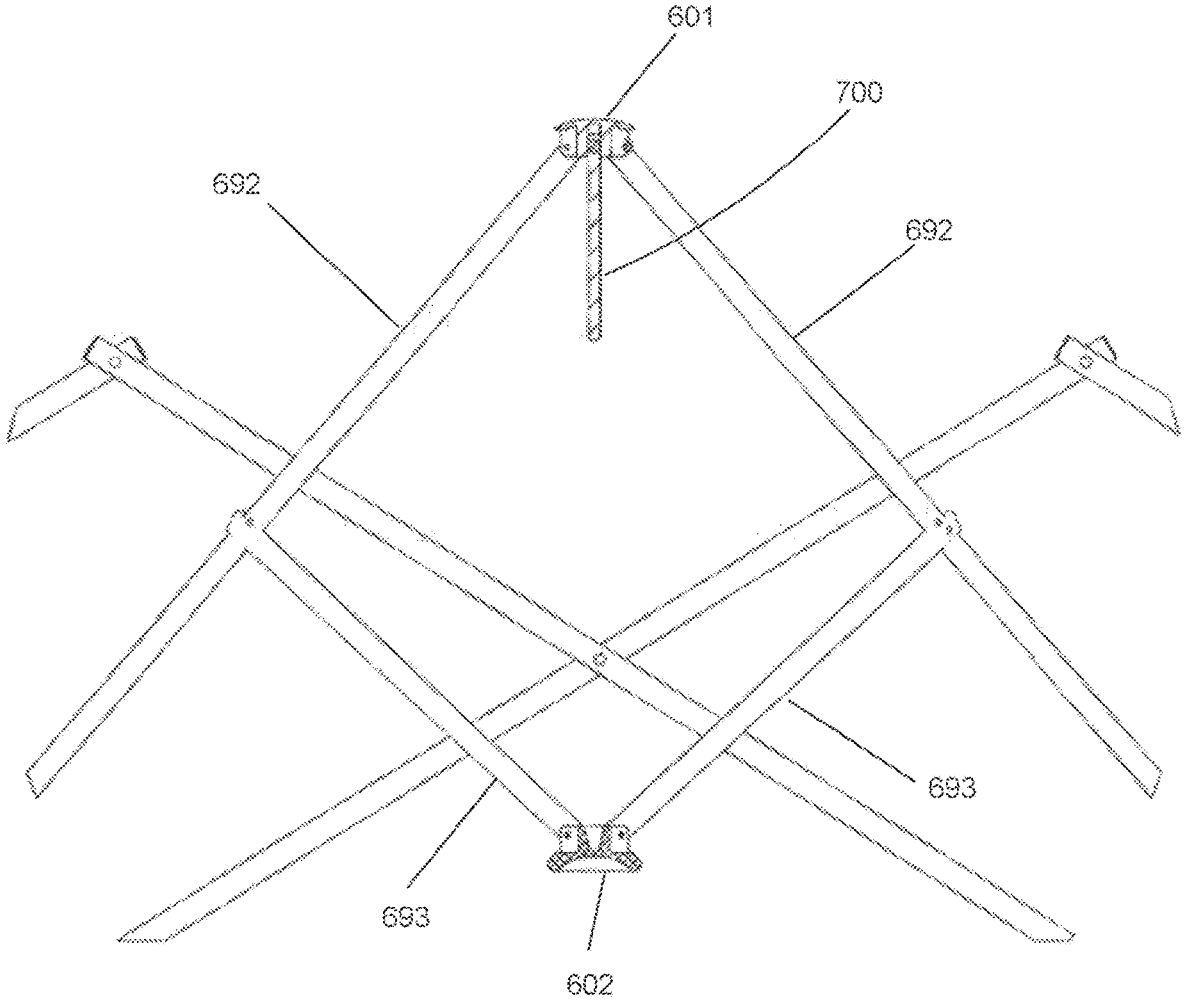

A first preferred embodiment showing collapsible canopy 750 is shown in FIGS. 1-4. In FIG. 1, center top cap 601 is pivotally connected to four first oblique top pipes 692. Center bottom cap 602 is pivotally connected to four bottom cap connecting rods 693. Four second oblique top pipes 694 are each pivotally connected to a first oblique top pipe 692 at one end and are each pivotally connected to a supporting leg 695 at the other end. Leg connecting rods 684 are pivotally connected between support legs 695 and second oblique top pipes 694, as shown. The pivot connection between center top cap 601 and support legs 695 of top pipes 692 and 694 form inner retractable units 615.

First eave pipes 671 and second eave pipes 672 are pivotally connected to supporting legs 695 and are pivotally connected to each other as shown. Middle eave pipes 673 and 674 are pivotally connected between first eave pipes 671 and second eave pipes 672, as shown. Pivotally connected eave pipes 671-674 form outer retractable units 614 that are pivotally connected between support legs 695.

Stop pole 700 is bolted onto center top cap 601 so that it is rigidly attached. Stop pole 700 extends downward from center top cap 601 as shown.

Figure 3:
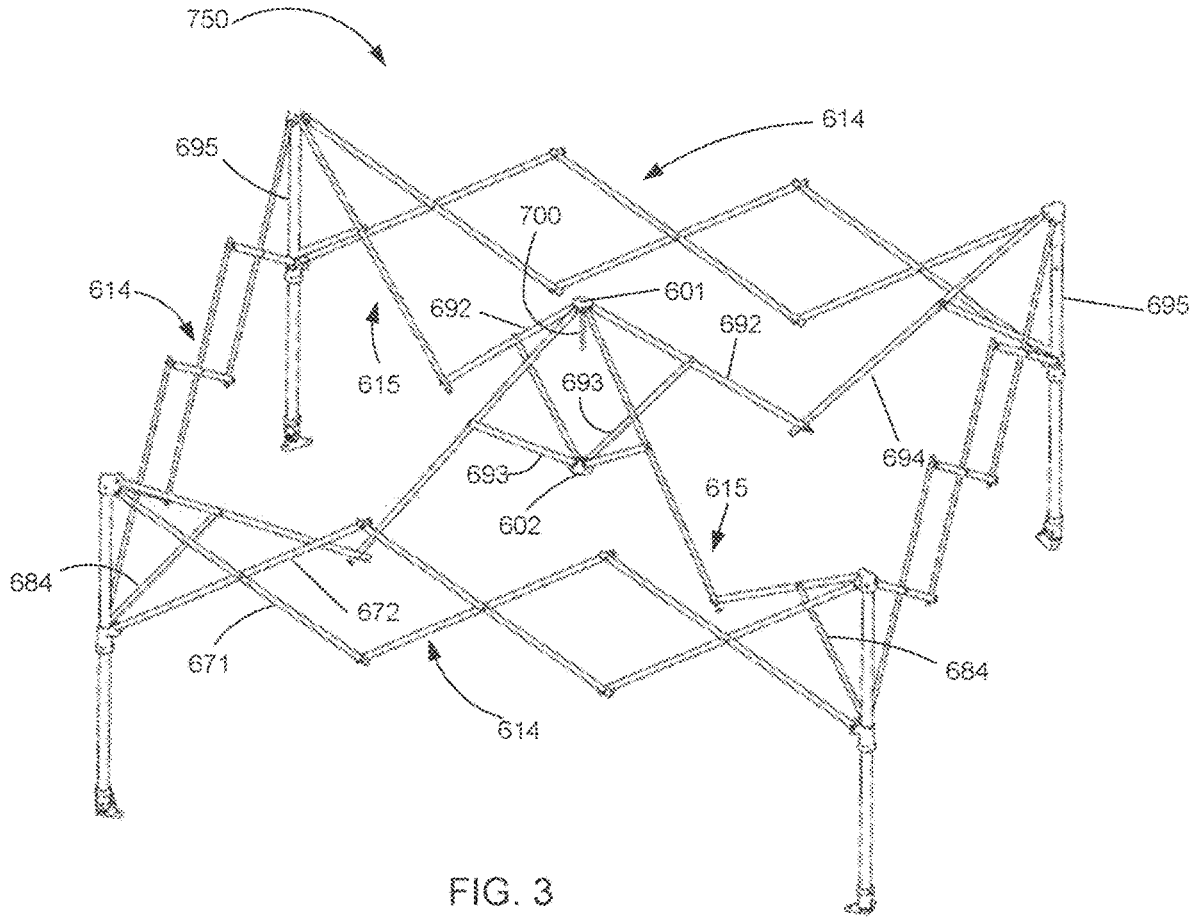
Figure 5:
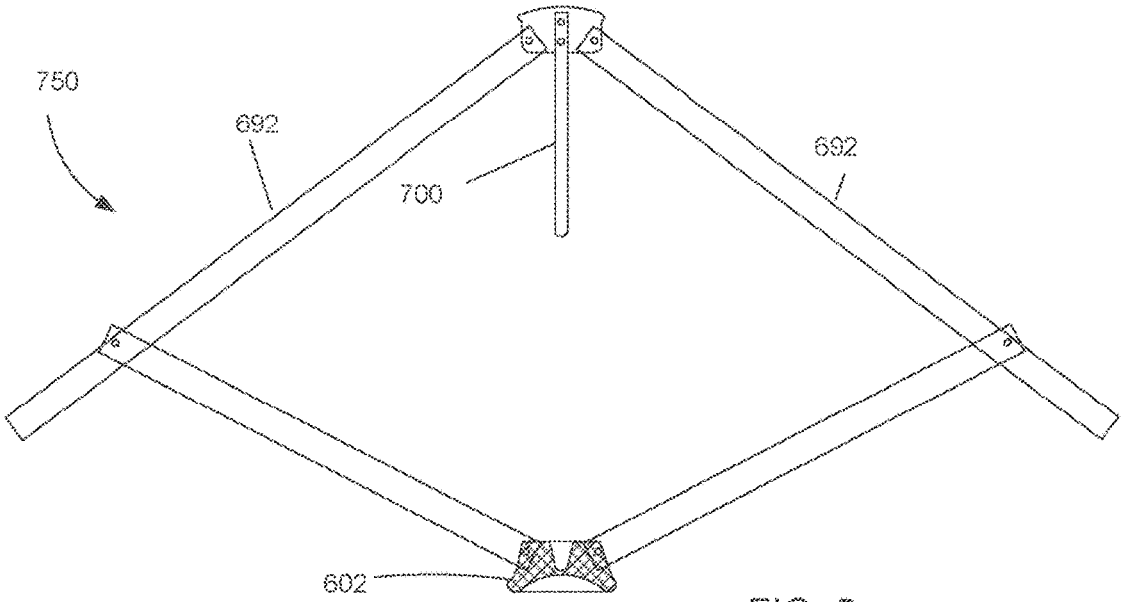

Operation of Preferred Embodiment with Stop Pole Connected to Center Top Cap FIG. 5 shows collapsible canopy 750 in an unlocked and collapsed position, similar to that depicted in FIG. 3. In FIG. 3 the force of gravity is pressing downwards on first oblique top pipes 692. The user has not yet pressed upward on center bottom cap 602.

Figure 6:
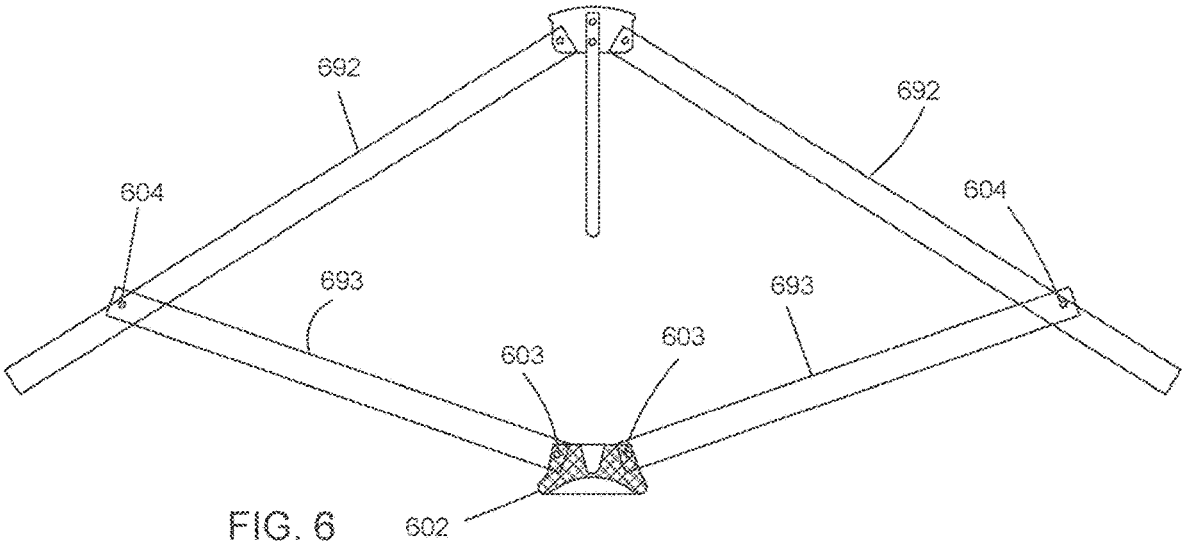

In FIG. 6, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 6, pivot axis 603 is lower than pivot axis 604. Therefore, the user must continue to press upward on bottom cap 602 to overcome the weight of oblique top pipes 692.

Figure 7:
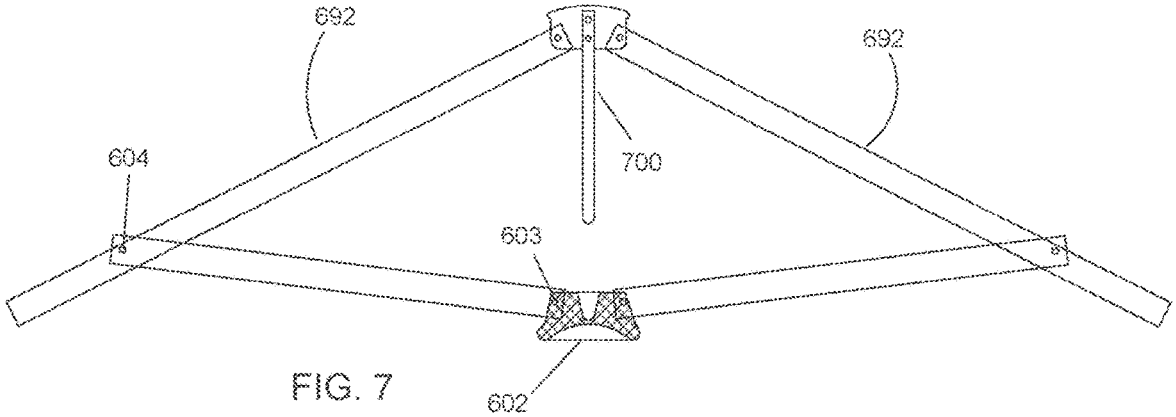

In FIG. 7, the user has pressed further upwards on bottom cap 602. Oblique top pipes 692 have pivoted further outwards. In FIG. 7, pivot axis 603 is still lower than pivot axis 604. Therefore, the user must still continue to press upward on bottom cap 602 to overcome the weight of oblique top pipes 692.

Figure 8:
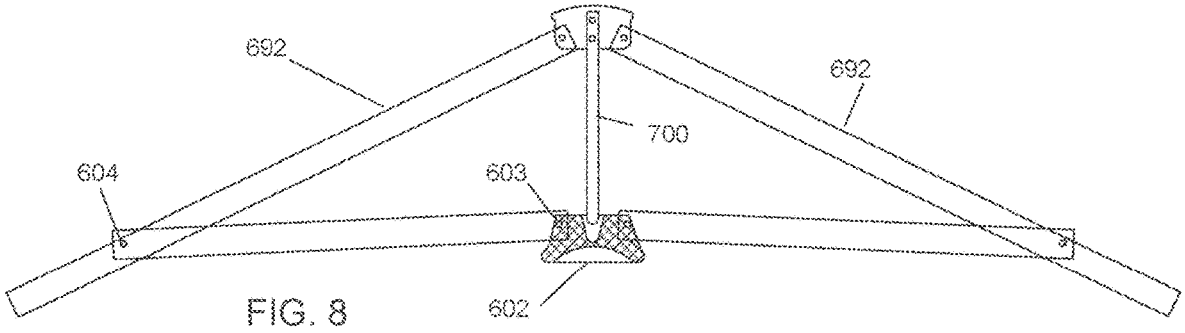

In FIG. 8, the user has pressed further upwards on bottom cap 602. Pivot axis 603 is now higher than pivot axis 604. Once the pivot axis 603 becomes higher than pivot axis 604, the weight of oblique top pipes 692 will cause bottom cap 602 to move upward so that the user no longer has to press upward on bottom cap 602. In FIG. 8, top pipes 692 have begun to pivot inwards and bottom cap 602 is being forced upwards towards stop pole 700. The user may now stop upwards pressure on bottom cap 602. The downward force provided by oblique top pipes 692 will move bottom cap 602 upwards until is stopped by stop pole 700.

Figure 4:
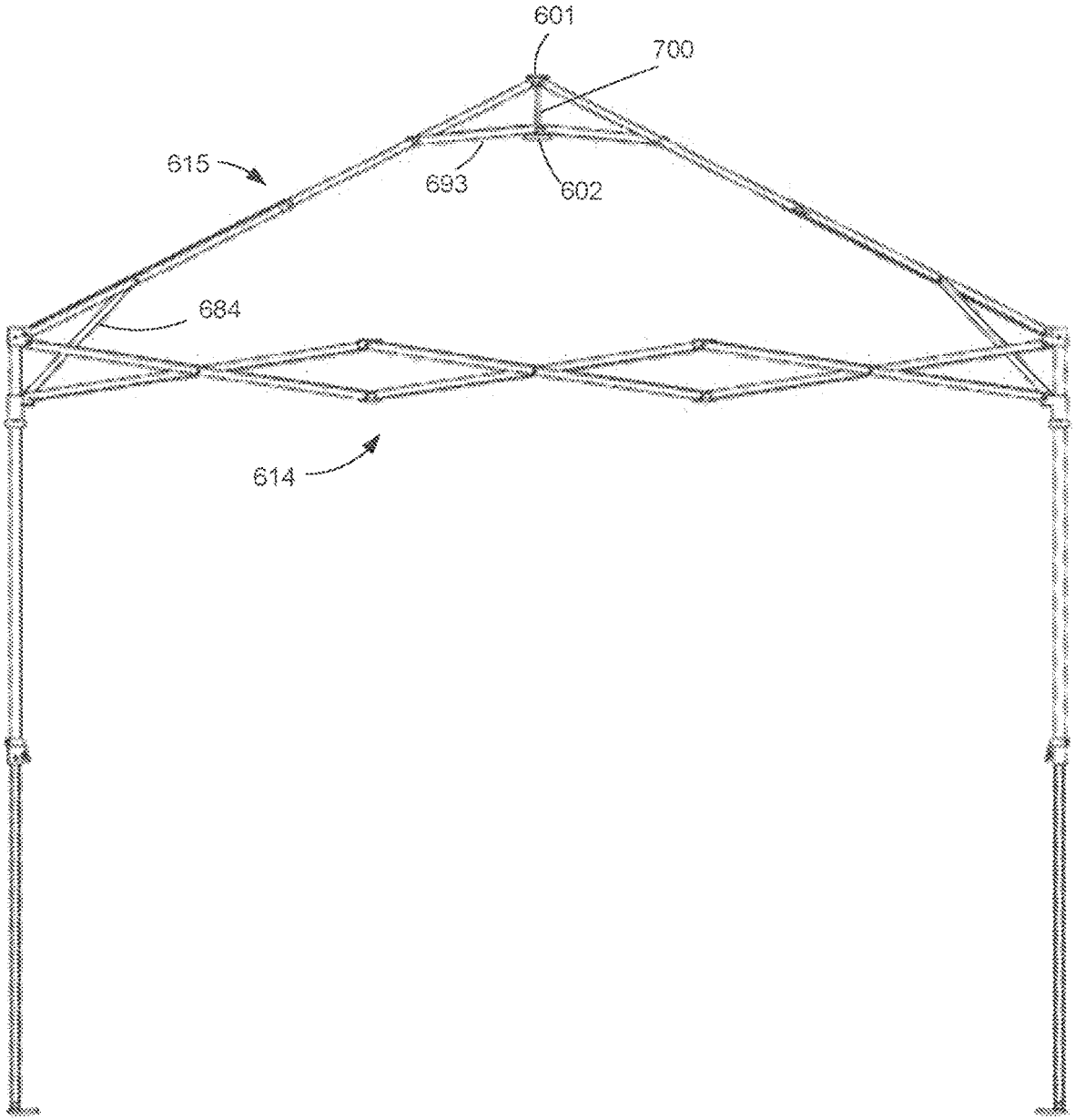
Figure 9:
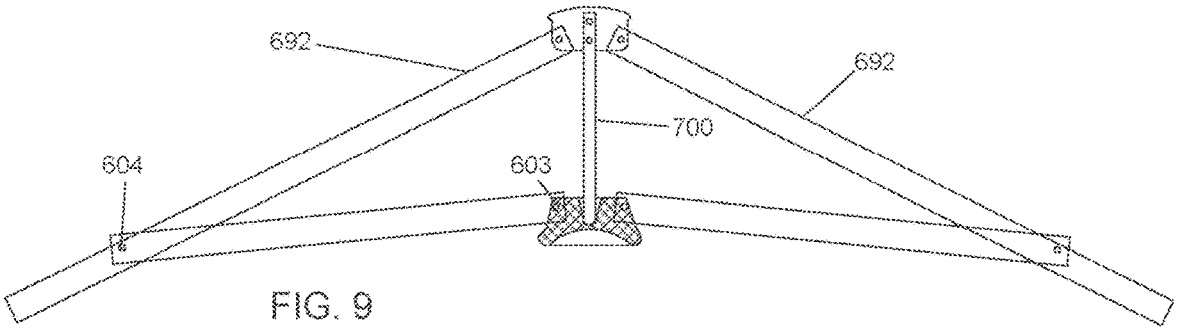

In FIG. 9, the downward force provided by oblique top pipes 692 has moved bottom cap 602 upwards so that it has been stopped by stop pole 700. Pivot axis 603 is higher than pivot axis 604. Center locking mechanism 720 is now in a self-locked position. It should be noted that a self-locked position is achieved after bottom cap pivot axis 603 becomes higher than top pipe pivot axis 604. After that occurs, the user may cease applying upward force onto bottom cap 602. The force of gravity acting on top pipes 692 will force bottom cap 602 upwards until it is stopped by a stopping device, such as stopping pole 700. Once the upward motion has been stopped collapsible canopy 750 will be in a secure, locked position, as shown in FIGS. 4 and 9.

To unlock collapsible canopy 750 the user will need to pull downward on bottom cap 602 until pivot axis 603 is lower than pivot axis 604. Once this occurs, the force of gravity will take over and collapsible canopy 750 will be in the unlocked position as shown in FIGS. 1 and 3.

Preferred Embodiment with Center Top Cap as the Stopping Device

Figure 10:
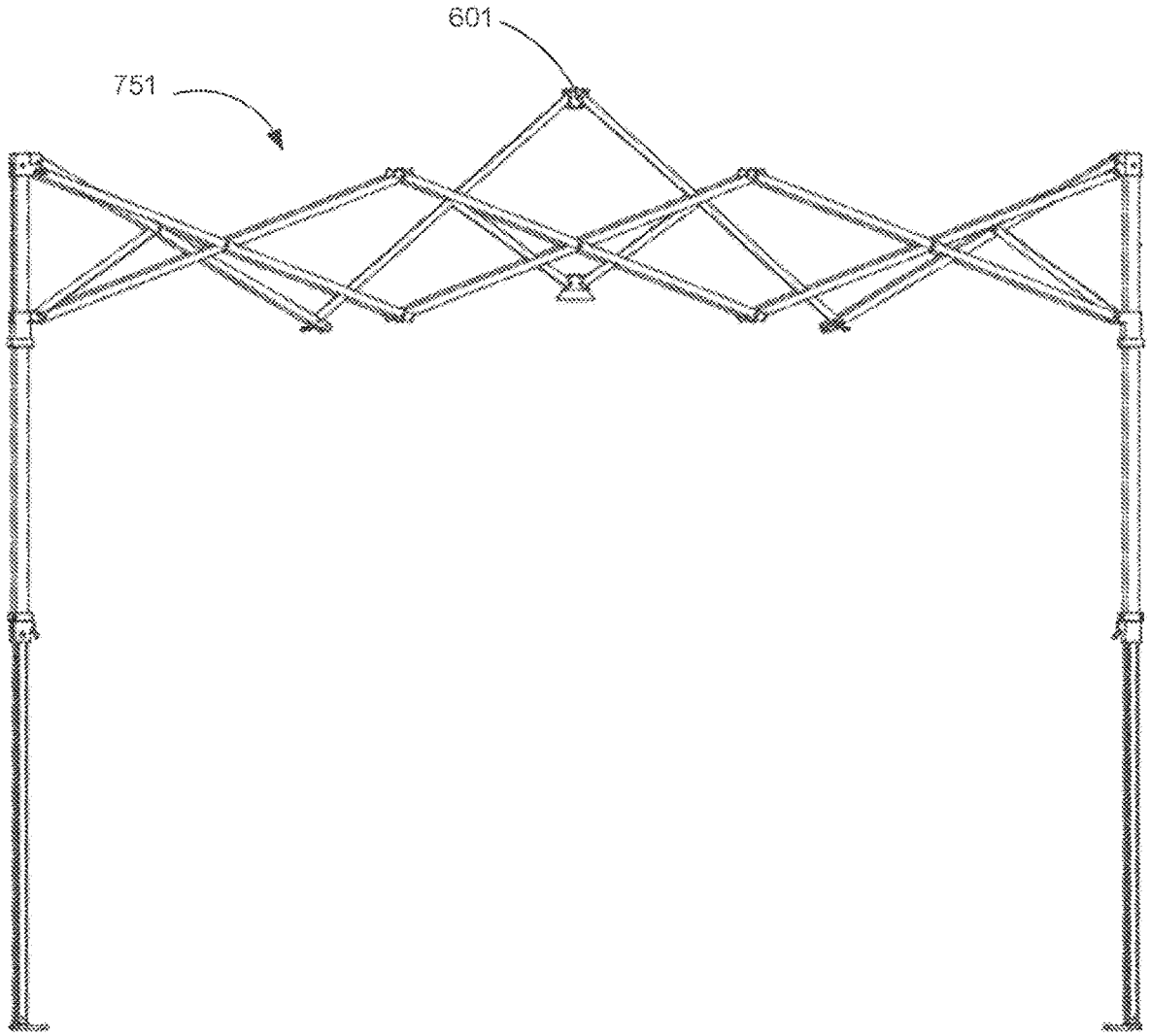
FIGS. 10-16 show another preferred embodiment of the present invention utilizing the central top cap as the stopping device.
Figure 11:
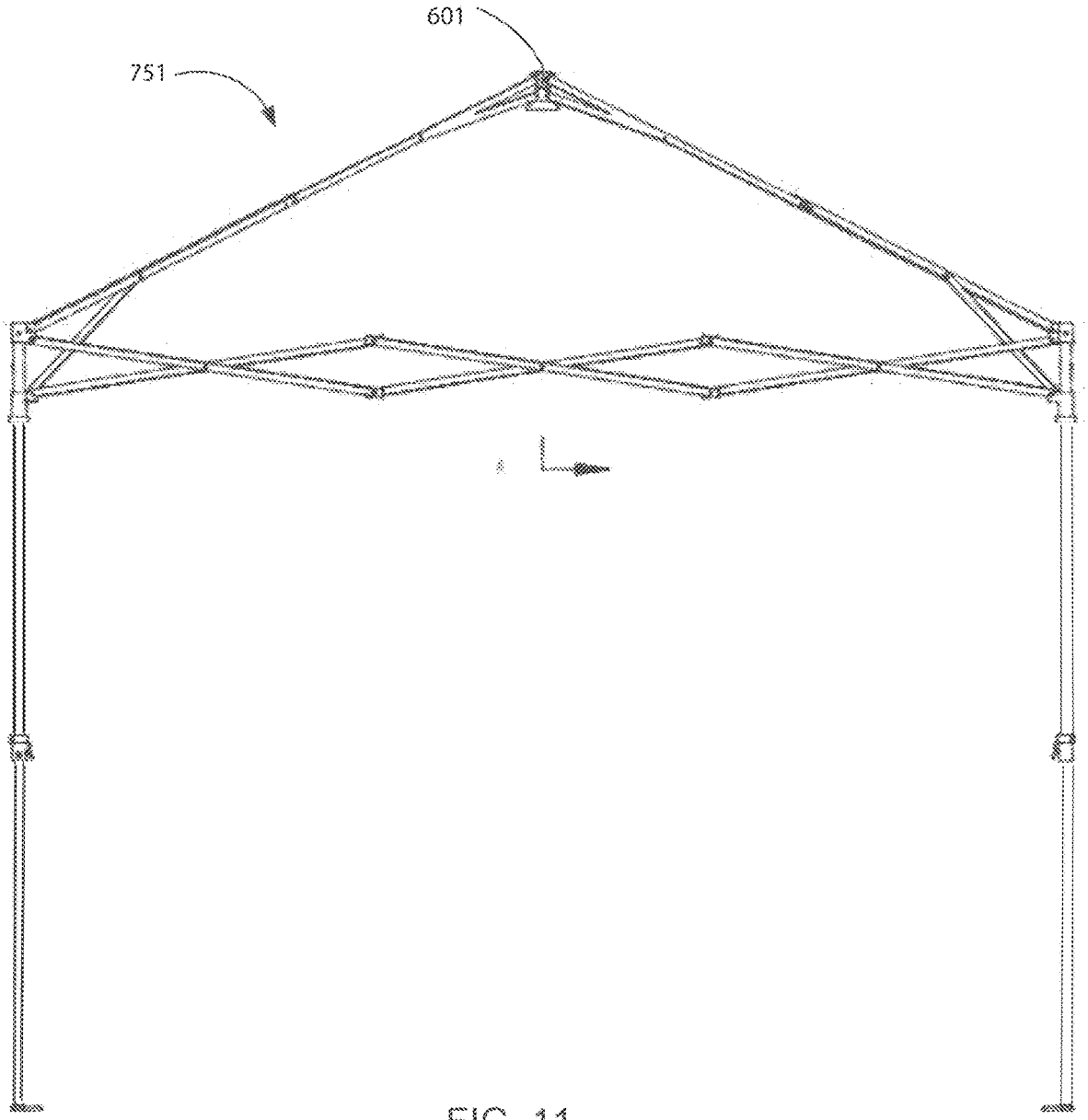

Another preferred embodiment showing collapsible canopy 751 is shown in FIGS. 10-11. Collapsible canopy 751 is very similar to collapsible canopy 750 described above. However, rather than utilizing stop pole 700, collapsible canopy 751 utilizes center top cap 601 as the stopping device. This embodiment is preferred due to its simplicity and its cost effectiveness.

Figure 12:
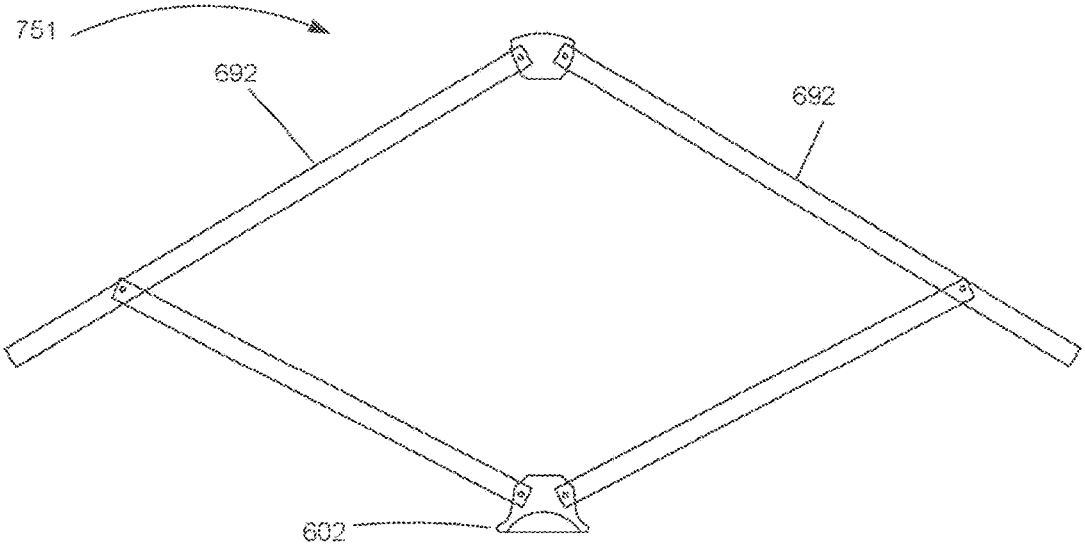

Operation of Preferred Embodiment Utilizing the Center Top Cap as the Stopping Device FIG. 12 shows collapsible canopy 751 in an unlocked and collapsed position, similar to that depicted in FIG. 12. In FIG. 12 the force of gravity is pressing downwards on first oblique top pipes 692. The user has not yet pressed upward on center bottom cap 602.

Figure 13:
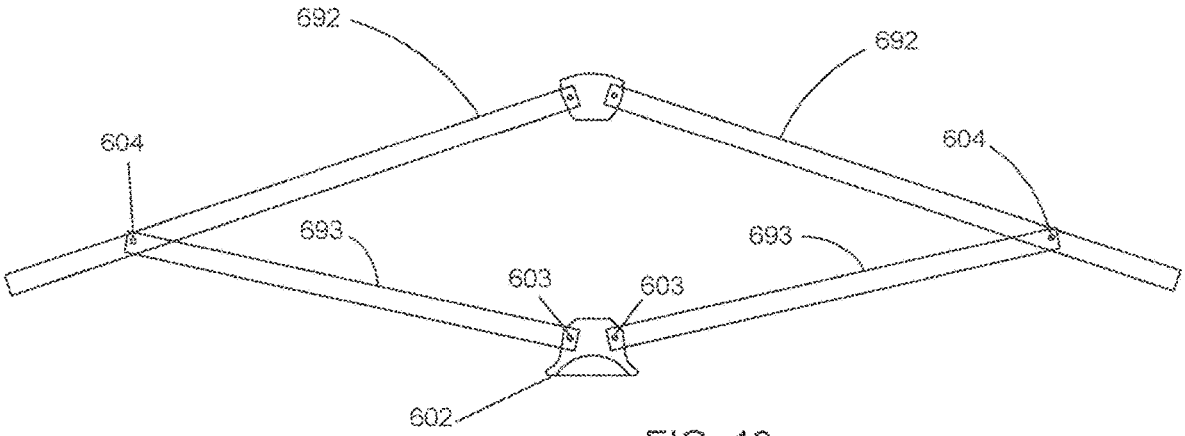

In FIG. 13, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 13 pivot axis 603 is lower than pivot axis 604. Therefore, the user must continue to press upward on bottom cap 602 to overcome the weight of oblique top pipes 692.

Figure 14:
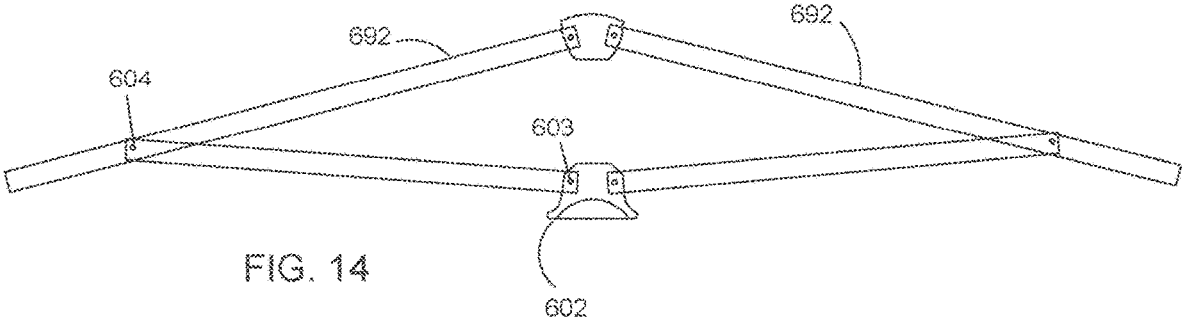

In FIG. 14, the user has pressed further upwards on bottom cap 602. Oblique top pipes 692 have pivoted further outwards. In FIG. 14, pivot axis 603 is still lower than pivot axis 604. Therefore, the user must still continue to press upward on bottom cap 602 to overcome the weight of oblique top pipes 692.

Figure 15:
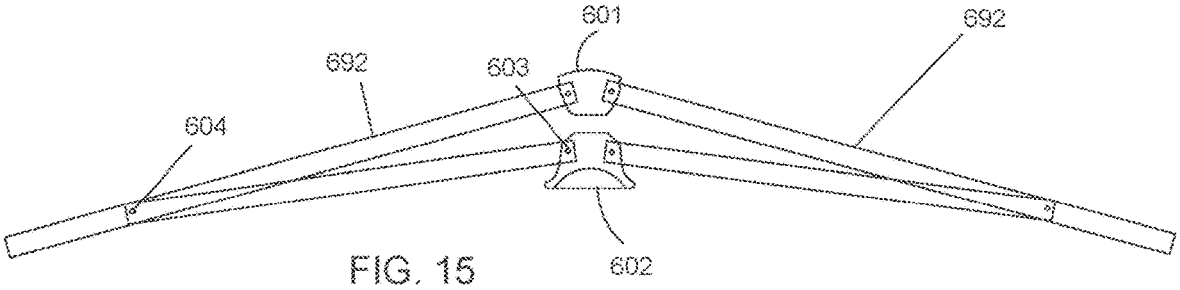

In FIG. 15, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 15, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until is stopped by center top cap 601.

Figure 16:
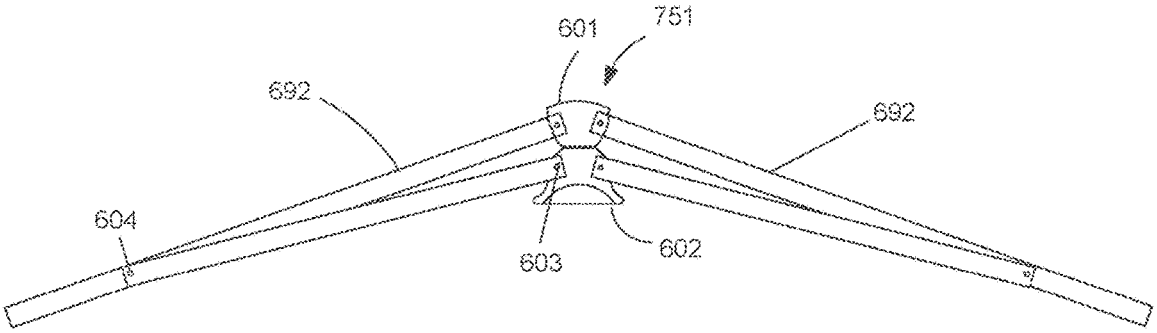

In FIG. 16, the downward force provided by oblique top pipes 692 has moved bottom cap 602 upwards so that it has been stopped by center top cap 601. Pivot axis 603 is higher than pivot axis 604. Center locking mechanism 721 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until it is stopped by a stopping device, such as center top cap 601. Once the upward motion has been stopped collapsible canopy 751 will be in a secure, locked position, as shown in FIGS. 16 and 11.

Figure 36:
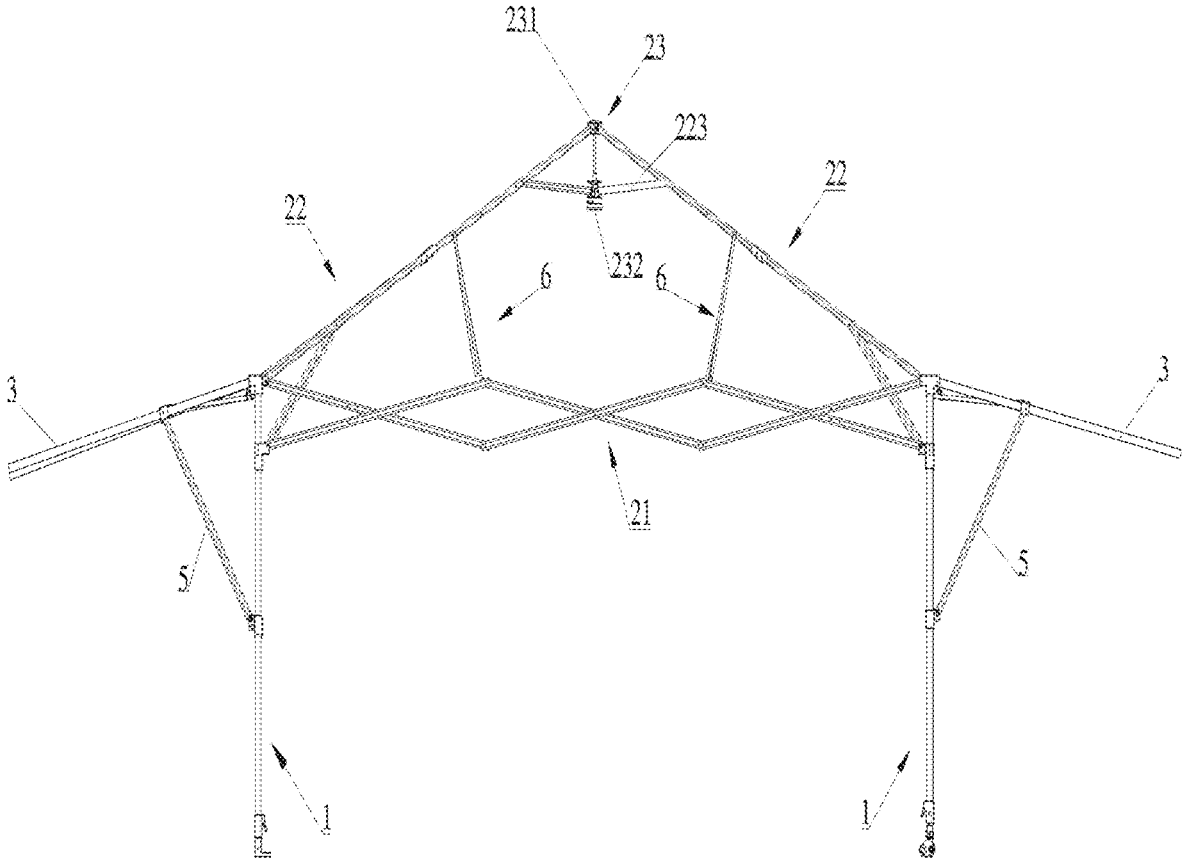
FIG. 36 is a front view of the canopy shown in FIG. 35.
Figure 38:
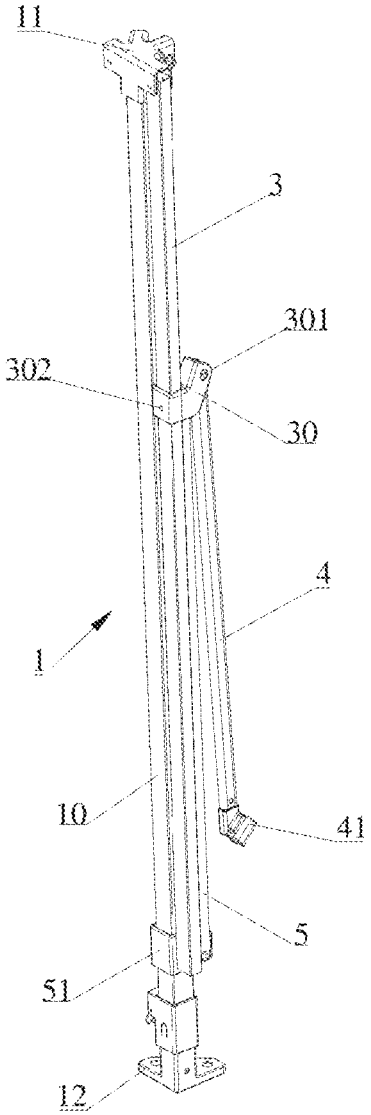
FIG. 38 shows a part of the canopy shown in FIG. 33, wherein the overhanging rods are not extended out.
Figure 39:
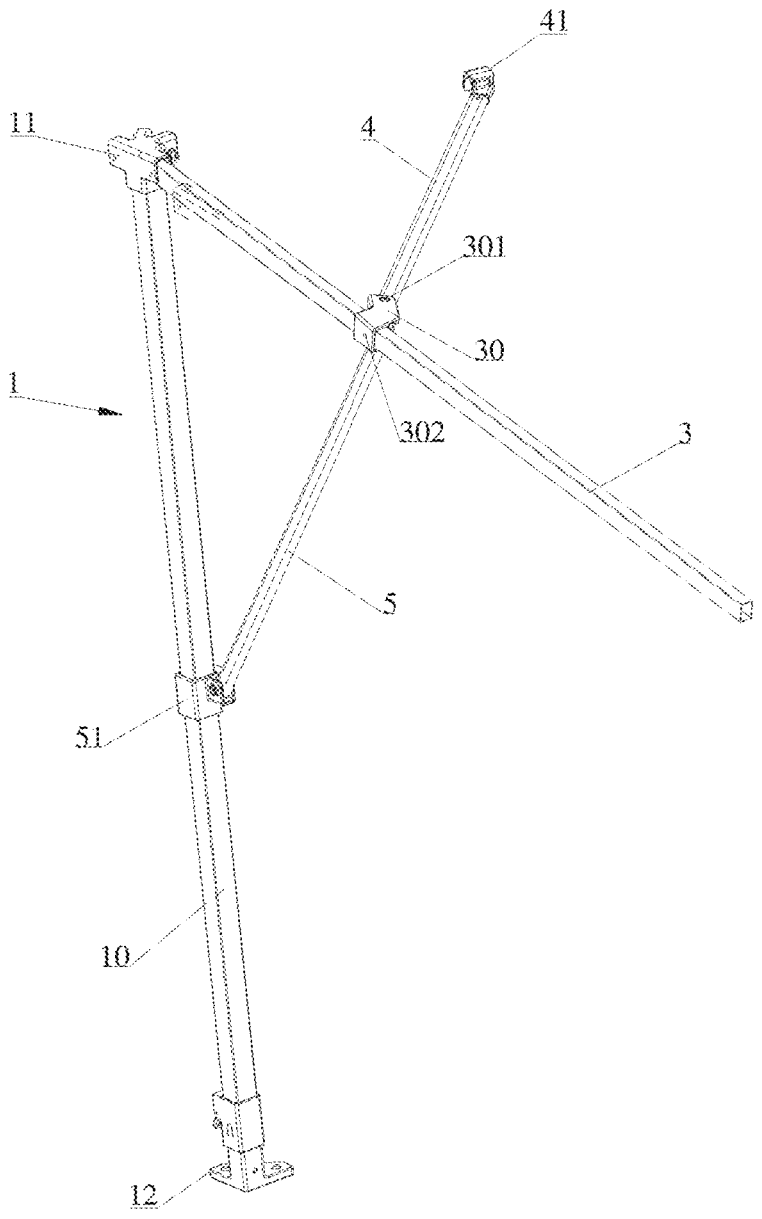
FIG. 39 is a schematic diagram of the part shown in FIG. 38, wherein the overhanging rods are extended out.
Figure 40:
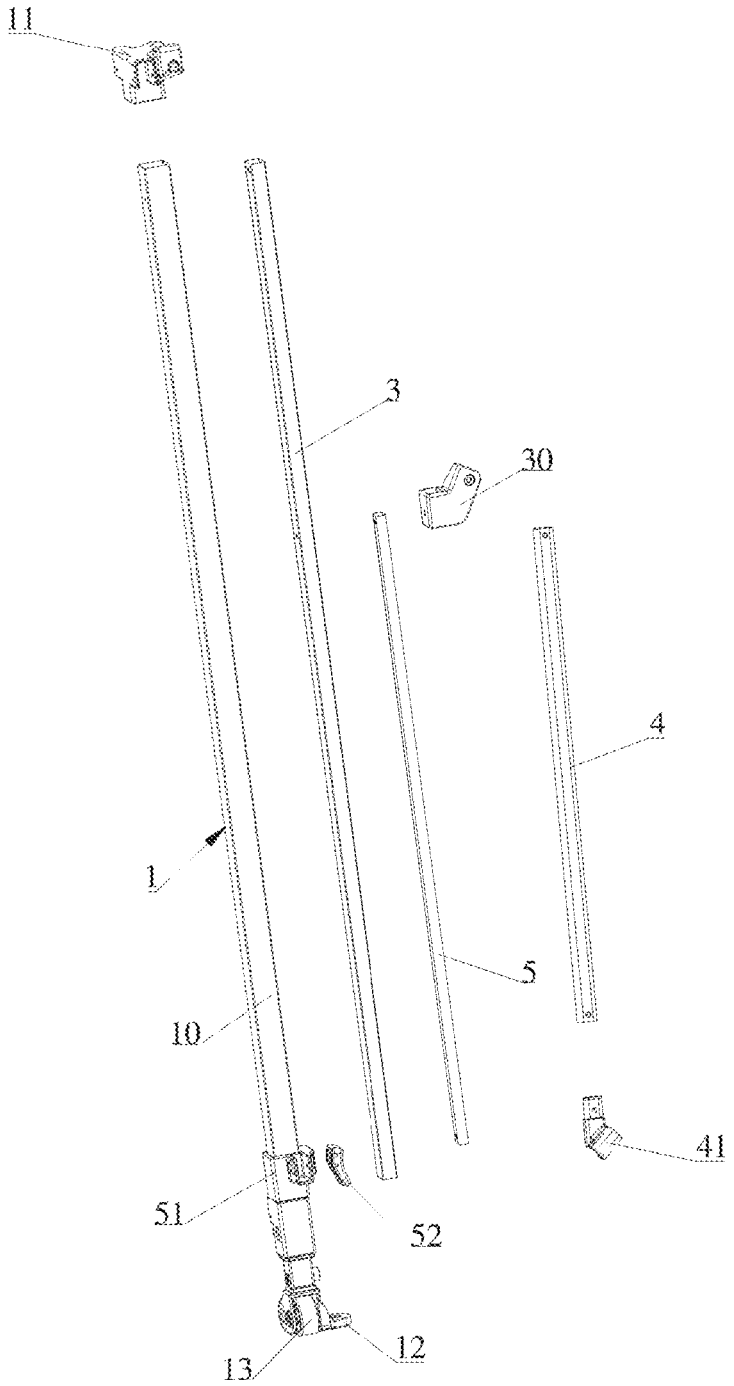
FIG. 40 is an exploded schematic view of another part of the canopy shown in FIG. 33.
Figure 41:
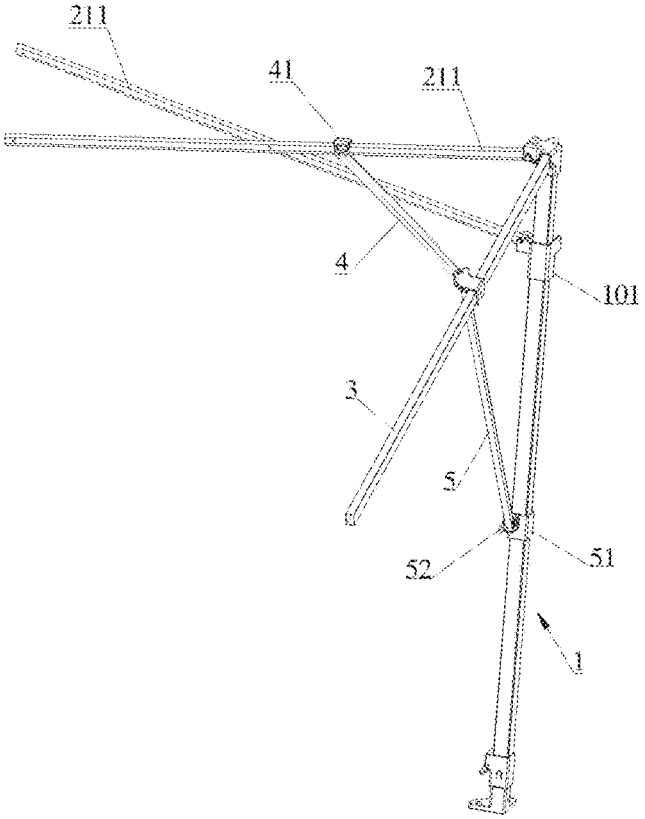
FIG. 41 is an exploded schematic view of still another part of the canopy shown in FIG. 33.

To unlock collapsible canopy 751 the user will need to pull downward on bottom cap 602 until pivot axis 603 is lower than pivot axis 604. Once this occurs, the force of gravity will take over and collapsible canopy 750 will be in the unlocked position as shown in FIGS. 36 and 38.

Figure 17:
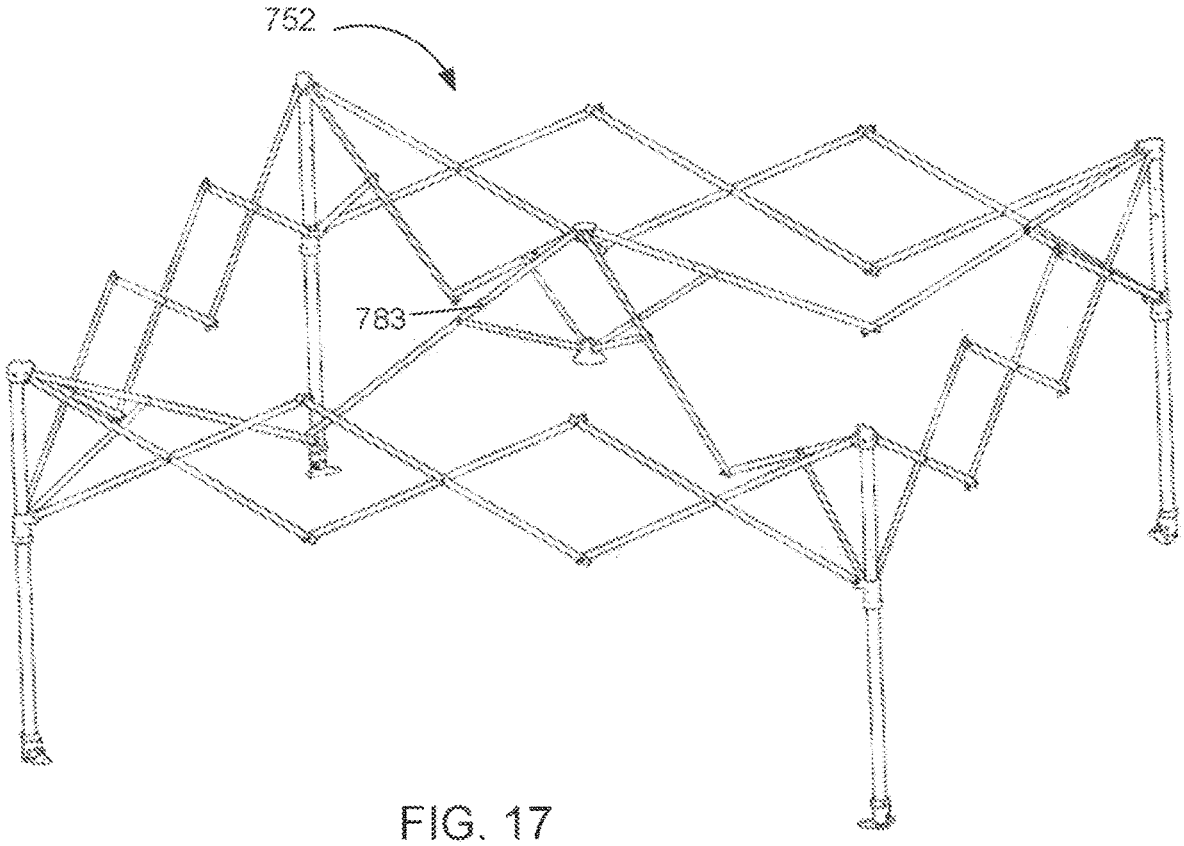
FIGS. 17-23 show another preferred embodiment of the present invention utilizing stopping plugs connected to top pipes as the stopping device.
Figure 18:
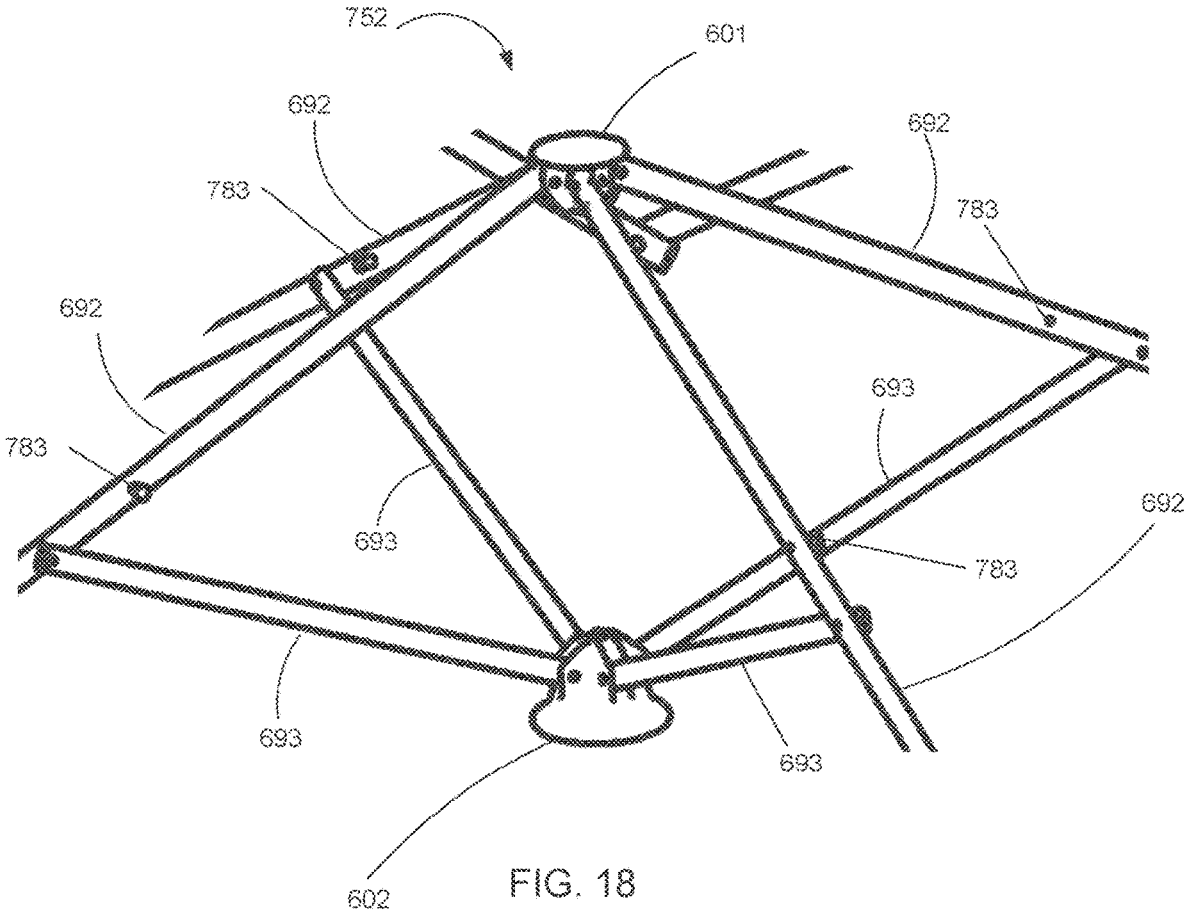
Figure 19:
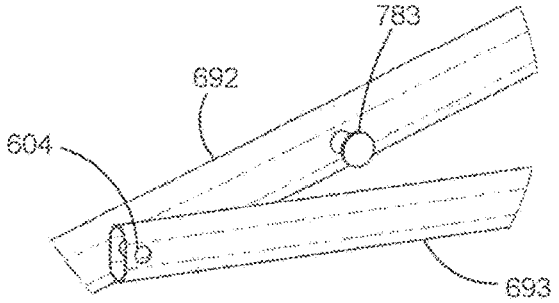

Preferred Embodiment with Plugs Mounted to the Top Pipes as the Stopping Device Another preferred embodiment showing collapsible canopy 752 is shown in FIGS. 17-18. Collapsible canopy 752 is very similar to collapsible canopies 751 and 752 described above. However, collapsible canopy 752 utilizes plugs 783 mounted to top pipes 692 as the stopping device. FIG. 19 shows a detailed view of plug 783 mounted to top pipe 692 over connecting rod 693 pivotally connected at pivot axis 604. This embodiment shows that a stopping device may be mounted to a top pipe.

Figure 20:
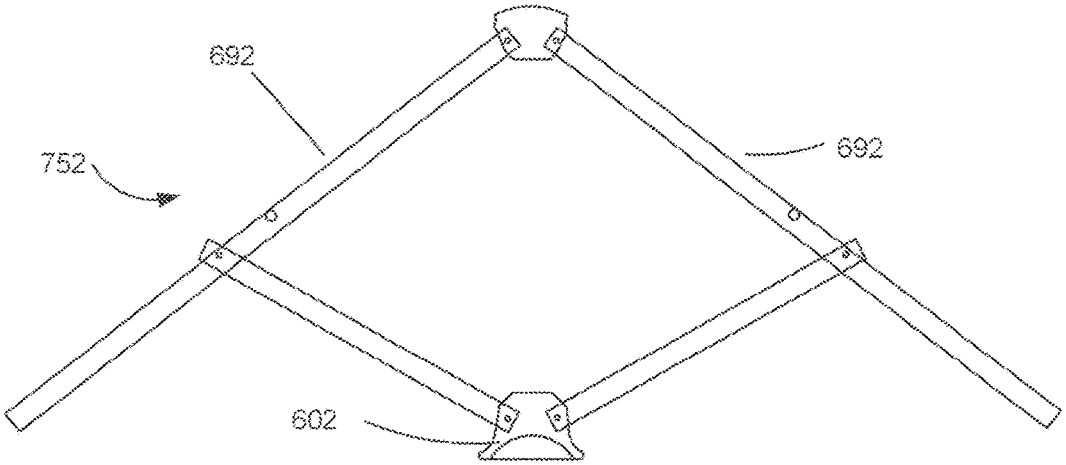

Operation of Preferred Embodiment Utilizing Top Pipe Mounted Plugs as the Stopping Device FIG. 20 shows collapsible canopy 752 in an unlocked and collapsed position, similar to that depicted in FIG. 17. In FIG. 20 the force of gravity is pressing downwards on first oblique top pipes 692. The user has not yet pressed upward on center bottom cap 602.

Figure 21:
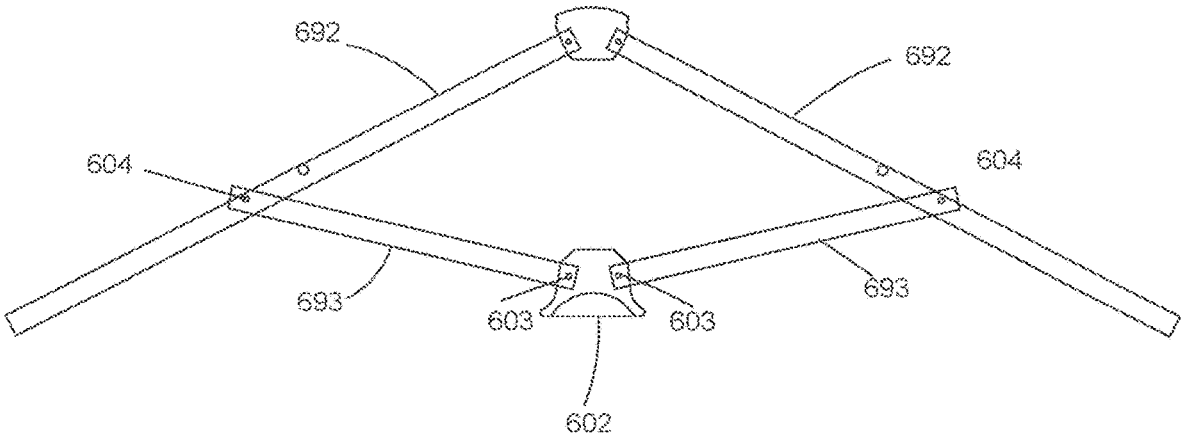

In FIG. 21, the user has begun to press upwards on bottom cap 602. Oblique top pipes 692 have begun to pivot outwards from center. Bottom cap connecting rods 693 are pivotally connected to bottom cap 602 at bottom cap pivot axis 603 and bottom cap connecting rods 693 are pivotally connected to oblique top pipes 692 at top pipe pivot axis 604. In FIG. 21, pivot axis 603 is lower than pivot axis 604. Therefore, the user must continue to press upward on bottom cap 602 to overcome the weight of oblique top pipes 692.

Figure 22:
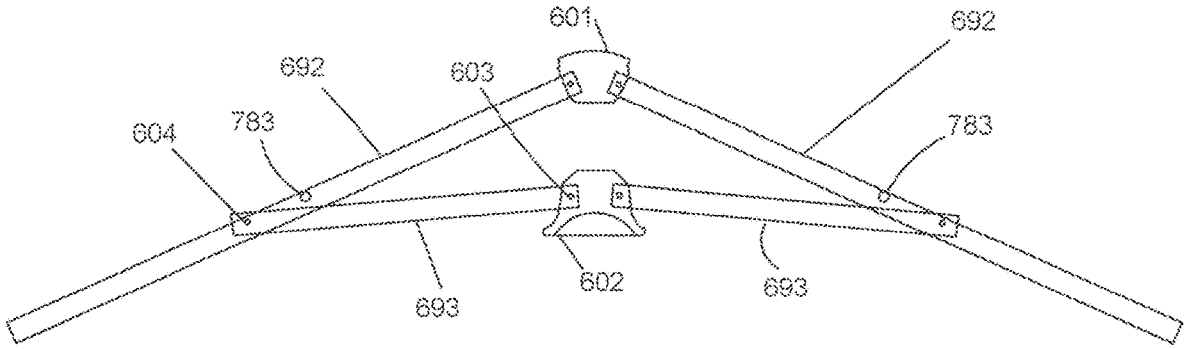

In FIG. 22, the user has pressed further upwards on bottom cap 602. Pivot axis 603 is now higher than pivot axis 604. Once the pivot axis 603 becomes higher than pivot axis 604, the weight of oblique pipes 692 will cause bottom cap 602 to move upward so that the user no longer has to press upward on bottom cap 602. In FIG. 22, top pipes 692 have begun to pivot inwards and bottom cap 602 is being forced upwards towards center top cap 601. The user may now stop upwards pressure on bottom cap 602. The downward force provided by oblique top pipes 692 will move bottom cap 602 upwards until connecting rods 693 are stopped by plugs 783.

Figure 23:
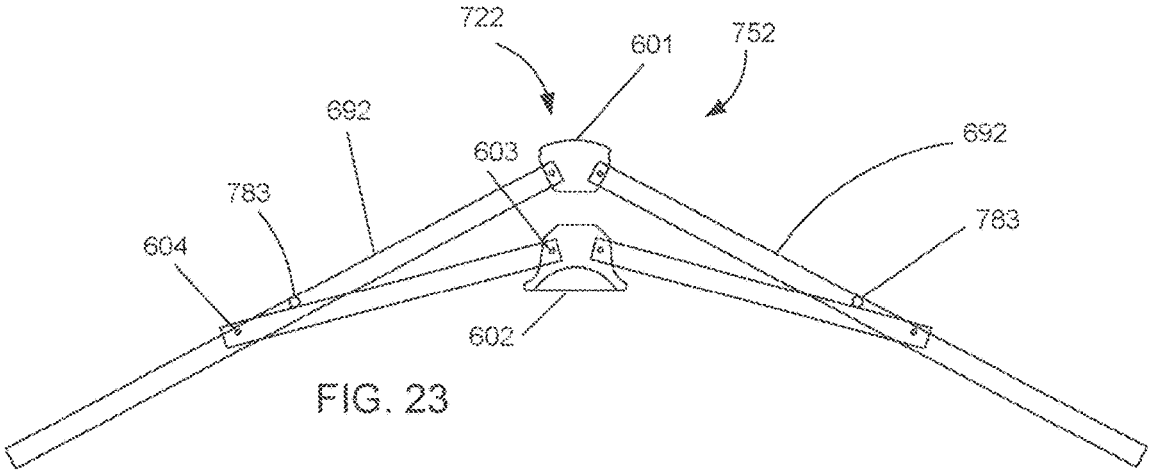

In FIG. 23, the downward force provided by oblique top pipes 692 has moved bottom cap 602 upwards so that the upward motion of connecting rods 693 has been stopped by plugs 783. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until connecting rods 693 are stopped by a stopping device, such as plugs 783. Once the upward motion has been stopped collapsible canopy 752 will be in a secure, locked position, as shown in FIG. 23.

To unlock collapsible canopy 752 the user will need to pull downward on bottom cap 602 until pivot axis 603 is lower than pivot axis 604. Once this occurs, the force of gravity will take over and collapsible canopy 752 will be in the unlocked position as shown in FIGS. 17 and 18.

Figure 24:
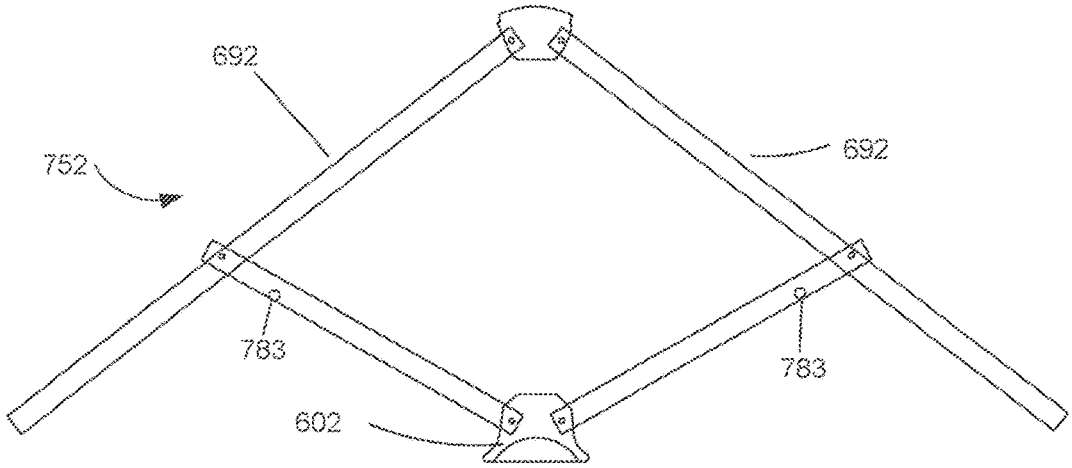
FIGS. 24-25 show another preferred embodiment of the present invention utilizing stopping plugs connected to connecting rods as the stopping device.
Figure 25:
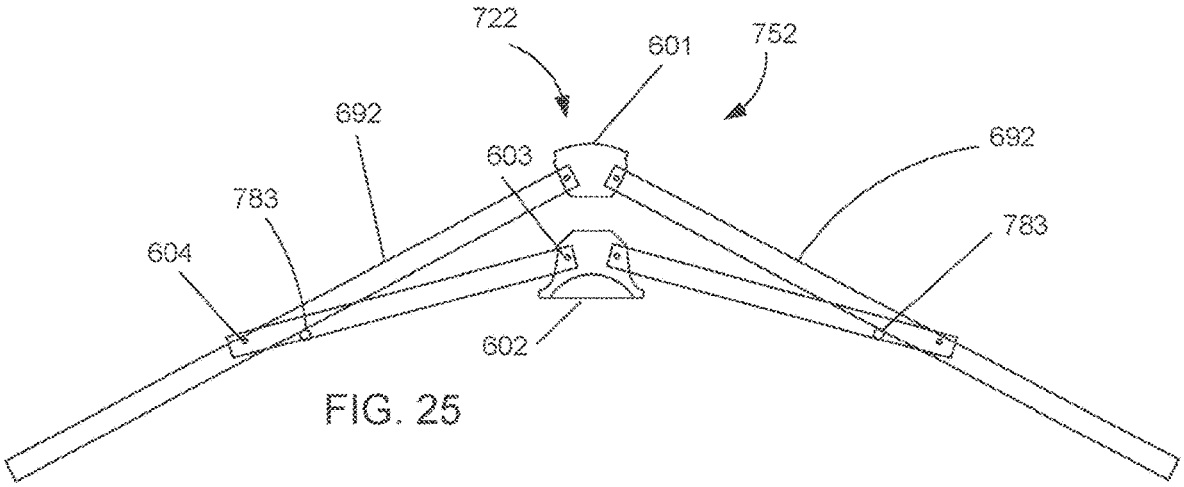

Preferred Embodiment with Plugs Mounted to Connecting Rods as the Stopping Device FIGS. 24 and 25 show plugs 783 mounted to connecting rods 693. This embodiment is similar to the previous embodiment with the exception that plugs 783 are mounted to connecting rods 693 rather than top pipes 692.

For example, in FIG. 25, the downward force provided by oblique top pipes 692 has moved bottom cap 602 upwards so that the upward motion of connecting rods 693 has been stopped by plugs 783 coming in contact with top pipes 692. Pivot axis 603 is higher than pivot axis 604. Center locking mechanism 722 is now in a self-locked position. It should be noted that a self-locked position is achieved after bottom cap pivot axis 603 becomes higher than top pipe pivot axis 604. After that occurs, the user may stop applying upward force onto bottom cap 602. The force of gravity acting on top pipes 692 will force bottom cap 602 upwards until the upward motion of connecting rods 693 is stopped by a stopping device, such as plugs 783 coming into contact with top pipes 692. Once the upward motion has been stopped collapsible canopy 752 will be in a secure, locked position, as shown in FIG. 25.

Preferred Embodiment Having Reinforcement Bars

Figure 26:
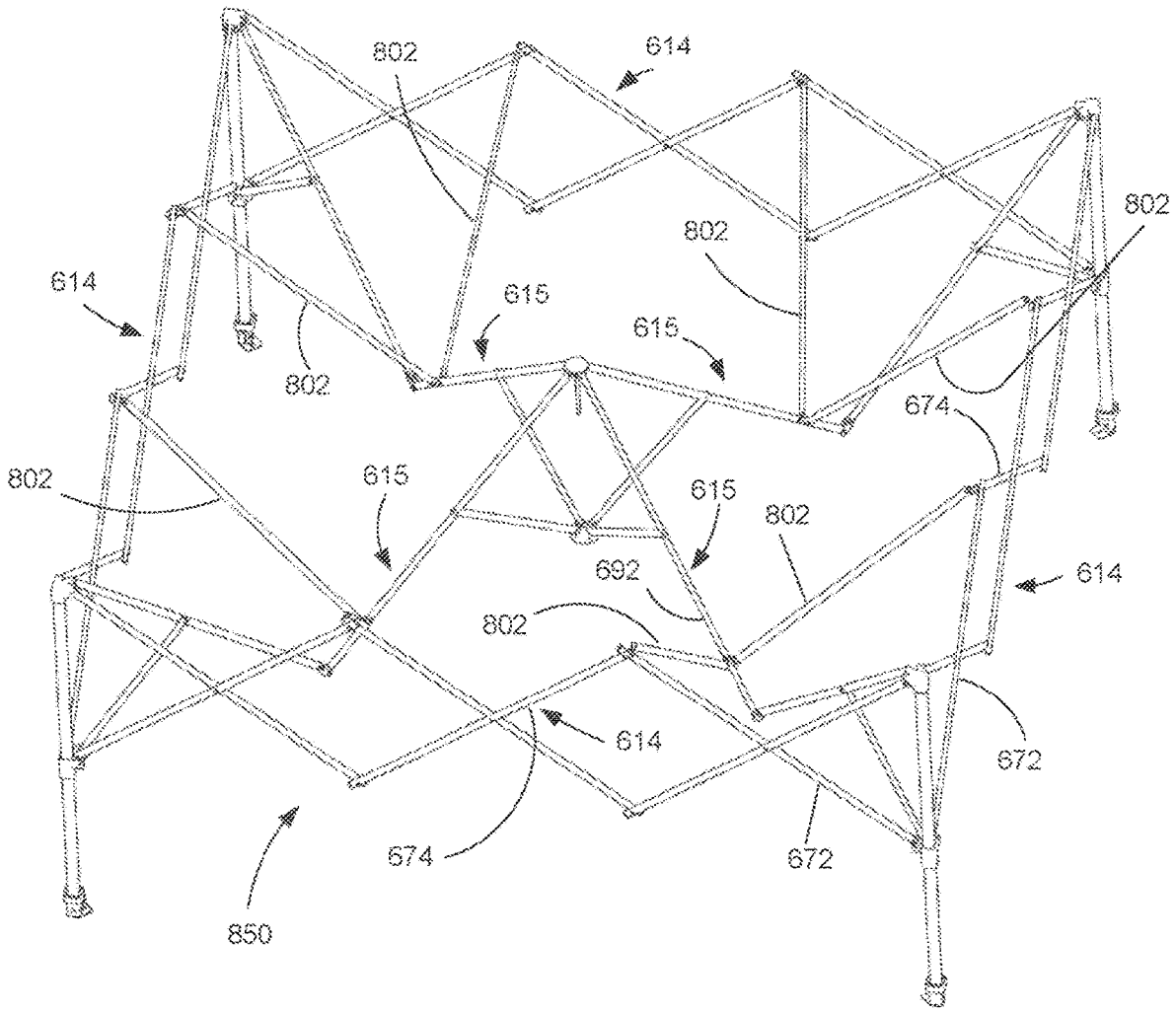
FIG. 26 shows another preferred embodiment of the present invention.

FIG. 26 shows another preferred embodiment of the present invention where collapsible canopy 850 has multiple reinforcement bars 802. Each reinforcement bar 802 is pivotally connected between inner retractable units 615 and outer retractable units 614. Specifically, in the preferred embodiment shown in FIG. 26 each reinforcement bar 802 is shown pivotally connected between first oblique top pipe 692 and at a position near the junction between second eave pipe 672 and middle eave pipe 674.

Figure 27:
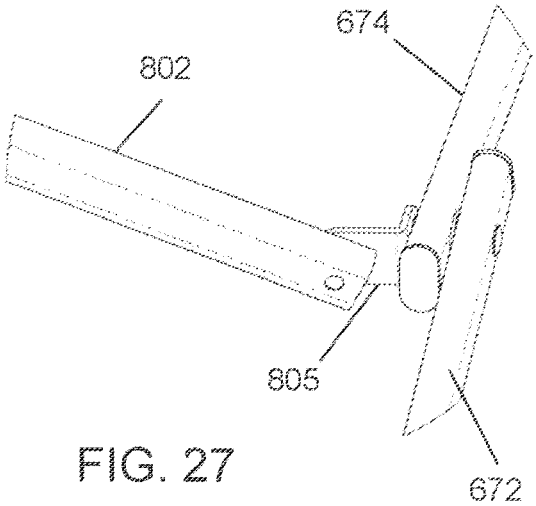
FIGS. 27-28 show detail perspective views of reinforcement bar pivot connection.
Figure 28:
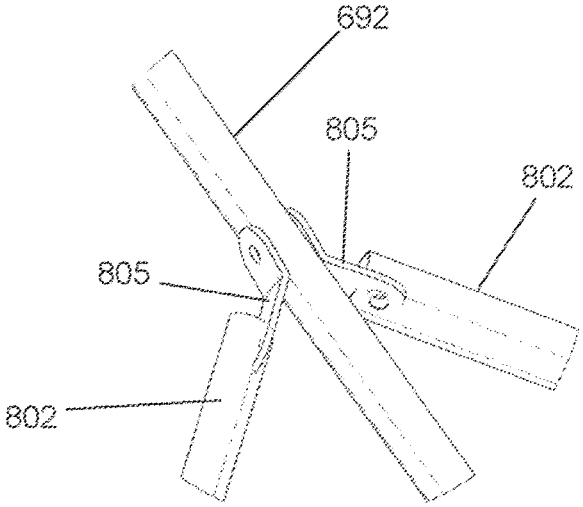

FIGS. 27 and 28 show detailed perspective views of the pivot connection of reinforcement bar 802. For example, in FIG. 27 reinforcement bar 802 is shown pivotally connected to middle eave pipe via connection bracket 805. Likewise, in FIG. 28 reinforcement bars 802 are shown pivotally connected to first oblique top pipe 692 via connection brackets 805.

Figure 29:
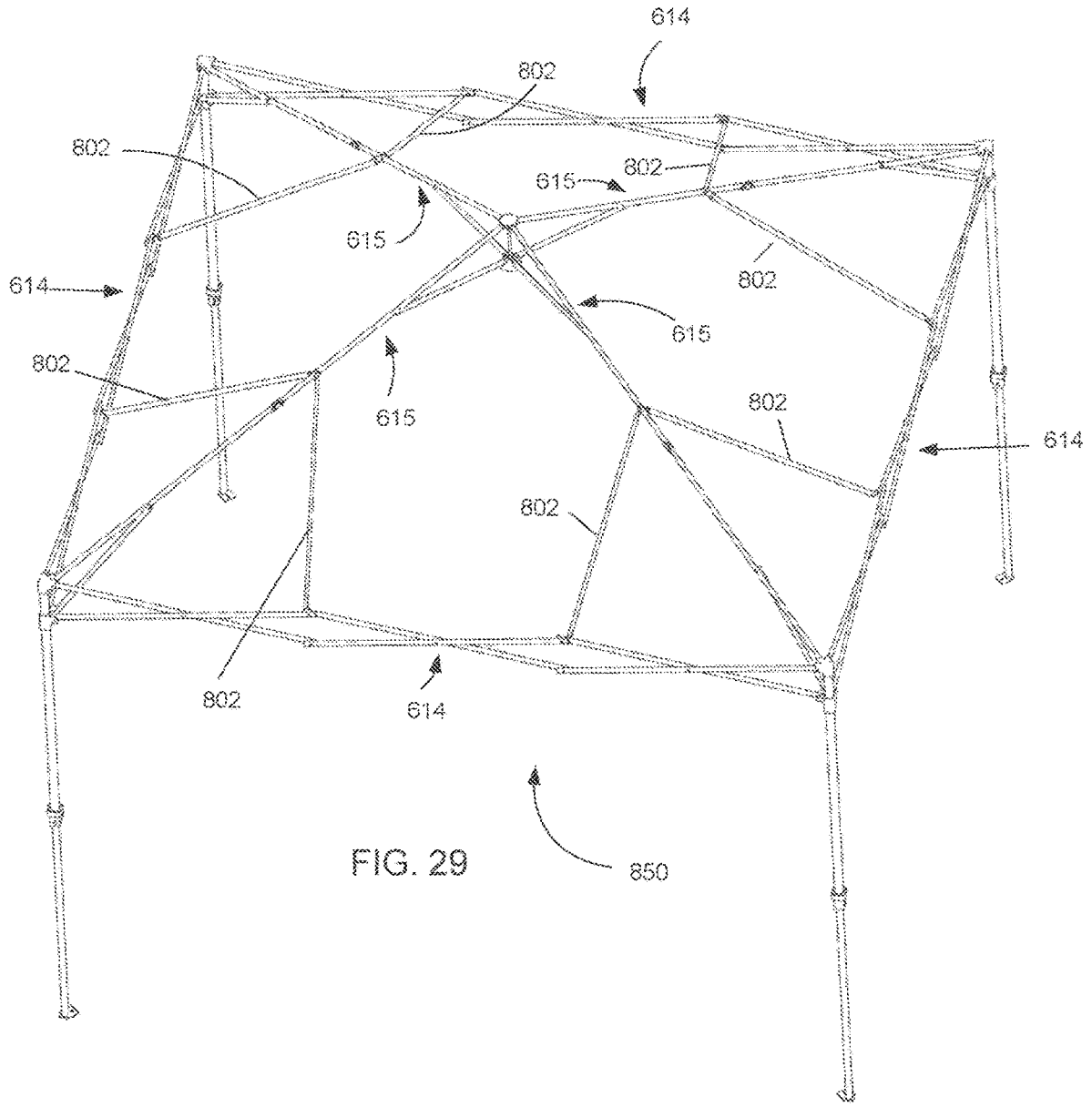
FIGS. 29-30 show a preferred canopy in a locked and unfolded position.

In FIG. 29, canopy 850 has been placed into a locked and unfolded position as shown. Reinforcement bars 802 are shown positioned between inner retractable units 615 and outer retractable units 614. Reinforcement bars 802 are rigid and will resist external forces acting on canopy 850 that will tend to deform the shape of canopy 850 in its locked position. For example, wind blowing against a locked and unfolded canopy 850 will be unable to press outer retractable units 614 inward because of the reinforcement provided by reinforcement bars 850.

Figure 30:
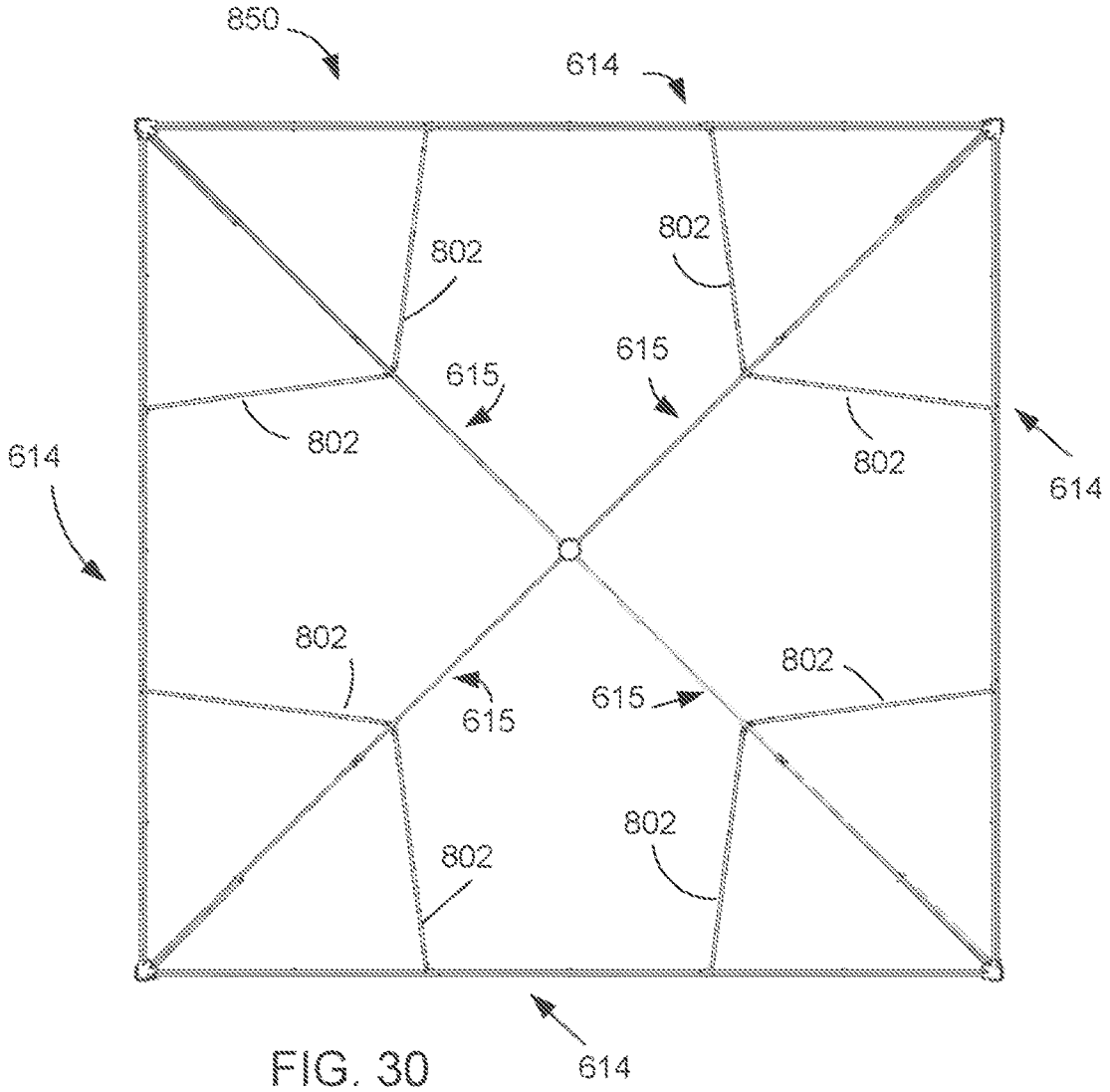

FIG. 30 shows a top view of canopy 850 in a locked and unfolded position. Reinforcement bars are clearly shown in position to resist deformation of the shape of canopy 850.

Figure 31:
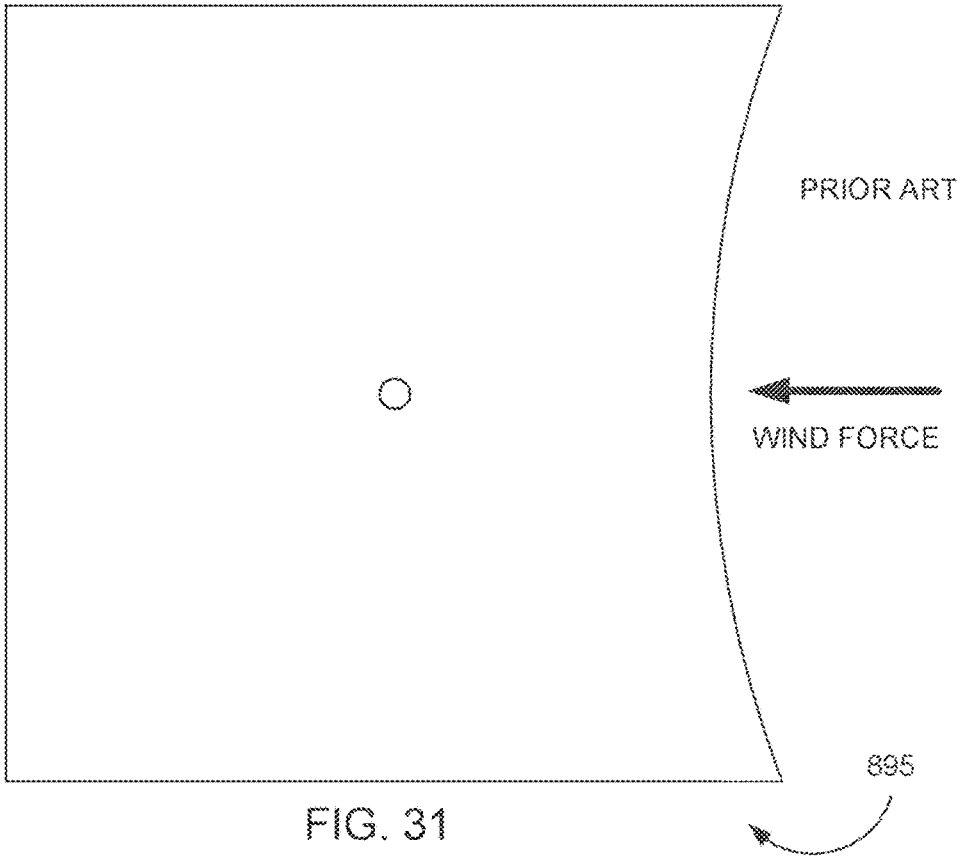
FIG. 31 shows a prior art canopy in a locked and unfolded position being deformed by wind force.

FIG. 31 shows prior art canopy 895 covered in fabric. Wind force is blowing against the side of canopy 895. Unfortunately canopy 895 has no means to resist this external force and consequently its side is deformed due to the action of the wind force.

Figure 32:
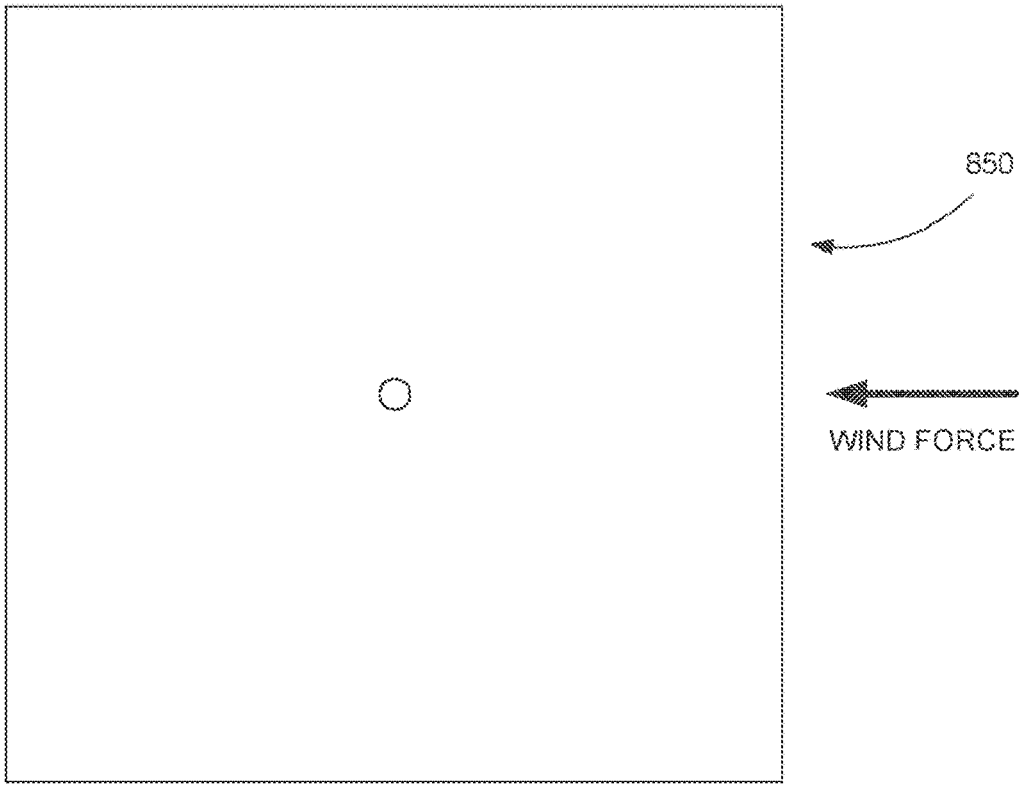
FIG. 32 shows a preferred canopy in a locked and unfolded position resisting deformation due to wind force.

FIG. 32, however, shows canopy 850 covered in fabric. Although wind force is blowing against the side of canopy 850, canopy 850 is able to maintain its shape. Reinforcement bars 802 (FIG. 30) provide optimum support and reinforcement and resist any tendency to deform the shape of canopy 850.

Preferred Embodiment with Overhanging Rods

Referring to FIG. 33 to FIG. 44, a collapsible canopy of this embodiment has an unfolded position and a folded position, and comprises a collapsible canopy frame body; the canopy frame body can be independently supported on the ground, and the canopy frame body is covered with a cloth cover for sunshading, rain sheltering and wind sheltering, etc.; a part of the cloth cover (for example, the edge part) can hang down from the sides of the canopy frame body, and this part of the cloth cover is called the surrounding cloth 70. In conjunction with FIG. 33 to FIG. 37, the canopy frame body comprises at least three supporting legs 1 extending in the up-down direction, and is supported on the ground by the supporting legs 1. The canopy frame body comprises a plurality of outer retractable units 21 and a plurality of inner retractable units 22 comprising inner ends, each outer retractable unit 21 is connected between two of the at least three supporting legs 1; each inner retractable unit 22 is connected to one of the at least three supporting legs 1, wherein the outer retractable units 21 and the inner retractable units 22 form a roof frame 2 of the collapsible canopy, and the cloth cover is mainly covered on the roof frame 2.

The canopy further comprises a plurality of overhanging rods 3 having an inner end portion and an outer end portion, the inner end portion of each overhanging rod 3 is rotatably connected to one of the supporting legs 1, specifically via a pivot shaft. The number and position of overhanging rods 3 correspond to the support legs 1 one to one, that is, the inner end portion of each overhanging rod 3 is rotatably connected to one corresponding supporting leg 1, the above-mentioned surrounding cloth 70 is connected to the outer end portions of the overhanging rods 3, and can be stretched by the overhanging rods 3 to be used as eaves to increase the shading area, and can also hang down on the sides of the canopy with the folding of the overhanging rods 3 for use as side surrounding cloth. Each overhanging rod 3 has a folded state and an unfolded state, and the outer end portion of the overhanging rod 3 is drawn close to the supporting leg 1 when in the folded state, and is offset from the supporting leg 1 by a distance when in the unfolded state. In other words, each overhanging rod 3 has folded state in which it is drawn close to the supporting leg 1 and an unfolded state in which it is unfolded with respect to the supporting leg 1. After the overhanging rod 3 is unfolded, the overhanging rod 3 is transverse to the supporting leg 1, so that the surrounding cloth 70 can be extended outward, which can increase the sunshade area of the canopy. Further, the overhanging rods 3 on the left extends to the left in their unfolded state, that is to say, the outer end portions of the overhanging rods 3 are located on the left side of the supporting legs 1; the overhanging rods 3 on the right extends to the right in their unfolded state, that is to say, the outer end portions of the overhanging rods 3 are located on the right side of the supporting legs 1; such that the surrounding cloths 70 on the left side and the right side are stretched to increase the eave areas on the left and right sides of the canopy, such that the sunshade areas on the left and right sides are increased. When the overhanging rods 3 are in the folded state, the surrounding cloths hang down and are located on the sides of the canopy.

It should be noted that: in this embodiment, the overhanging rods 3 are directly connected to the supporting legs 1 via pivot shafts; and in some other embodiments, the overhanging rods 3 can be indirectly connected to the supporting legs 1 through other components, such as sliding sleeve, connecting cap, etc. that rotatably connected to the supporting legs 1.

The canopy further comprises a plurality of cross bars, and the number and position of the cross bars 4 correspond to the overhanging rods 3 one to one. In conjunction with FIG. 38 to FIG. 44, each cross bar 4 has a first end portion for rotatably connecting to one of the overhanging rod 3 and a second end portion for detachably connecting to one of the outer retractable unit 21. When the overhanging rod 3 is in the folded state, the second end portion of the cross bar 4 is disconnected from the outer retractable unit 21, and when the overhanging rod 3 is in the unfolded state, the second end portion of the cross bar 4 is connected to the outer retractable unit 21. During folding the canopy frame body from the unfolded position to the folded position, the second end portion of the cross bar 4 is automatically disconnected from the outer retractable unit 21, and the overhanging rod 3 is converted from the unfolded state to the folded state. The second end portion of the cross bar 4 and a rod of the outer retractable unit 21 are detachably connected, and are configured to be able to be automatically disconnected from the outer retractable unit 21 during the folding of the outer retractable unit 21, and one of the implementations will be described in detail below.

Figure 44:
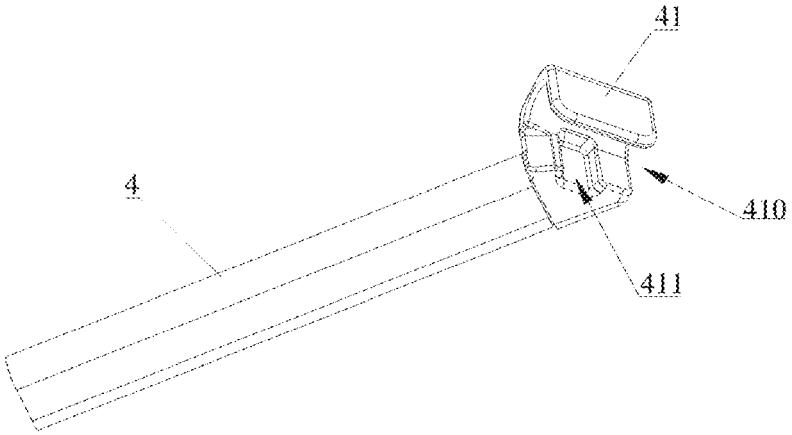
FIG. 44 is a schematic structure diagram of the second end portion of the cross bar according to another preferred embodiment of the present disclosure.

Each outer retractable unit 21 comprises an eave rod 211 capable of turning downward when the canopy frame body is folded; a clamping slot portion 41 capable of accommodating the eave rod 211 is formed on the second end portion of the cross bar 4, and the clamping slot portion 41 has an opening 410 facing downward, as shown in FIG. 44. A clamping slot formed by the clamping slot portion 41 preferably extends upward from the lower surface of the clamping slot portion 41, and in the section of the clamping slot portion 41 perpendicular to the length direction of the eave rod 211, the profile of the clamping slot is generally an inverted U shape. When folding the canopy frame body, the eave rod 211 will turn downward, and the cross bar 4 is forced by the overhanging rod 3 to automatically disconnected from the eave rod 211 during folding the collapsible canopy from the unfolded position to the folded position, so as to release from the clamping slot of the clamping slot portion 41, the cross bar 4 and the outer retractable unit 21 are disconnected to avoid the failure of the folding of the canopy frame body or the damage to the overhanging rod 3 or the rods of the canopy frame body due to forgetting to fold the overhanging rod 3.

Figure 42:
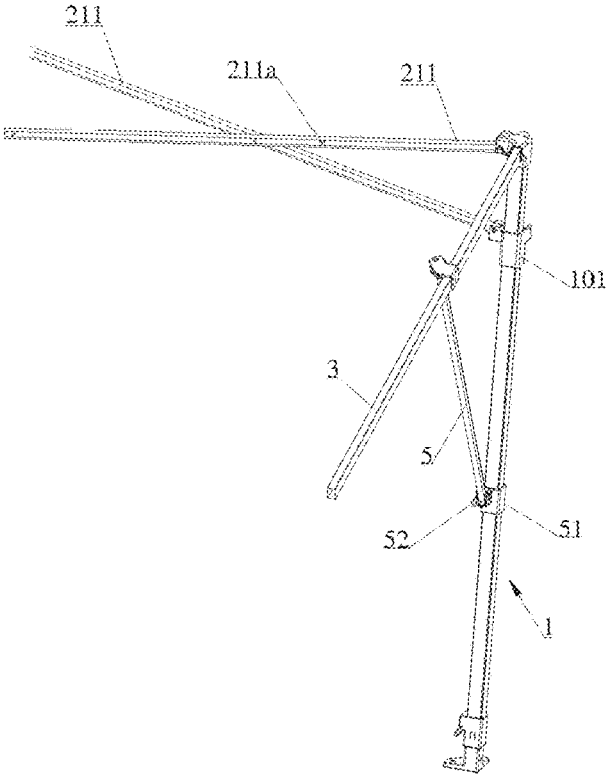
FIG. 42 is a schematic diagram of the part shown in FIG. 41, wherein no cross bar is shown.
Figure 43:
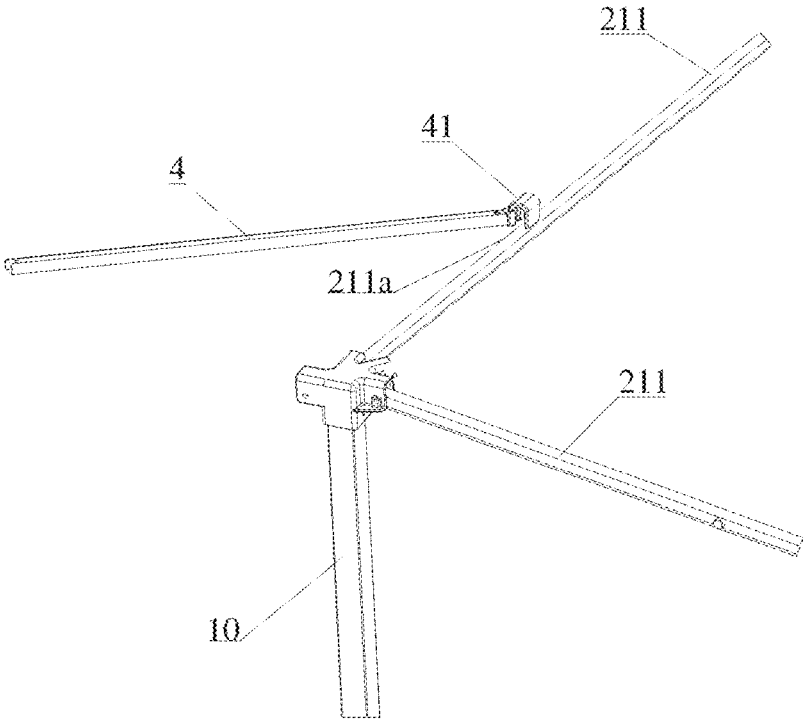
FIG. 43 is a schematic diagram of the connecting process of the second end portion of the cross bar and the connecting rod according to another preferred embodiment of the present disclosure.

In conjunction with FIG. 42 to FIG. 44, a positioning protrusion 211*a* is formed on the eave rod 211 matched with the cross bar 4, and the clamping slot portion 41 has a positioning groove 411 matched with the positioning protrusion 211*a*, to limit the sliding of the clamping slot portion 41 in the length direction of the eave rod 211. The positioning groove 411 communicates with the clamping slot formed by the clamping slot portion 41 and extends upward from the lower surface of the clamping slot portion 41, and during the process of clamping the clamping slot portion 41 onto the eave rod 211, the positioning protrusion 211*a* enters the positioning groove 411; the positioning groove 411 has two opposite limiting walls, and each limiting wall as a whole is not parallel to the length direction of the eave rod 211; the positioning protrusion 211*a* is located between the two limiting walls, to prevent the clamping slot portion 41 from moving forward and backward on the eave rod 211. The positioning protrusion 211*a* specifically comprises a pin, a pull nail, or a rivet fixed on the eave rod 211. In this embodiment, each of the cross bars 4 is a single bar; while in some other embodiments, each cross bar 4 may be composed of a plurality of rods.

The canopy further comprises a plurality of supporting rod 5 having a first end portion and a second portion, and the number and position of the supporting rods 5 correspond to the overhanging rods 3 one to one. In conjunction with FIG. 42 to FIG. 44, the first end portion of each supporting rod 5 is rotatably connected to the supporting leg 1 and capable of sliding in an up-down direction, and the second end portion is rotatably connected to the overhanging rod 3. Specifically, the first end portion of the supporting rod 5 is rotatably connected to a supporting seat 51, and the supporting seat 51 is slidably connected to the supporting leg 1 and capable of sliding in the up-down direction. The supporting seat 51 is preferably a sliding sleeve slidably sleeved on the supporting leg 1 in the up-down direction, and the lower end portion of the supporting rod 5 is pivotally connected to the sliding sleeve and the upper end portion thereof is connected to the overhanging rod 3. Overhanging lock mechanisms are provided between the supporting seats 51 and the supporting legs 1, respectively, and when the overhanging rod 3 is in the unfolded state, the overhanging lock mechanism locks the supporting seat 51 and the supporting leg 1. The overhanging lock mechanism may utilize an known structure, for example, a locking member (not shown) is arranged on the supporting seat 51, a locking hole (not shown) matched with the locking member is arranged on the supporting leg 1, and the locking member is releasably inserted into the locking hole. When in the unfolded state, the locking member on the supporting seat 51 is inserted into the locking hole to lock the overhanging rod 3 in the unfolded state, so that it can be unfolded stably; when it needs to be converted to the folded state, an unlock button 52 on the supporting seat 51 is pressed to release the locking member from the locking hole, the supporting seat 51 is slided downward to the lower portion of the supporting leg 1, to drive the overhanging rod 3 to fold until the outer end portion thereof is drawn close to the supporting leg 1, and at the same time, the first end portion (lower end portion) of the supporting rod 5 is drawn close to the lower portion of the supporting leg 1.

Further, a fixing seat 30 is arranged between the inner end portion and the outer end portion of the overhanging rod 3, and the fixing seat is located approximately in the middle of the overhanging rod 3. The first end portion of the cross bar 4 is rotatably connected to the fixing seat 30 via a first pivot shaft 301, and the second end portion (upper end portion) of the supporting rod 5 is rotatably connected to the fixing seat 30 via a second pivot shaft 302. An angle formed between the axial line of the first pivot shaft 301 and/or the second pivot shaft 302 and the horizontal plane when the overhanging rod 3 is in the folded state is less than 10 degrees. Specifically speaking, when the overhanging rod 3 is in the folded state, the axial line of the first pivot shaft 301 and the axial line of the second pivot shaft 302 are preferably parallel to the horizontal plane or only inclined at a small angle, and the axial line of the pivot shaft connecting the overhanging rod 3 and the supporting leg 1 is preferably parallel to the horizontal plane or only inclined at a small angle, so that the overhanging rod 3 and the cross bar 4 can automatically fall under the action of their own gravity and hang down on the sides of the supporting leg 1. Further, when the overhanging rod 3 is in the folded state, the supporting rod 5 is drawn close to the front side or rear side of the overhanging rod 3, and when viewed form the front side or rear side, the supporting rod 5 is completely shielded by the overhanging rod 3.

In conjunction with FIG. 42 to FIG. 44, the supporting leg 1 comprises a supporting leg body 10 extending in the up-down direction, a fixing joint 11 fixed to the upper end portion of the supporting leg body 10, and a foot pad fixed to the lower end portion of the supporting leg body 10; the inner end portion of the overhanging rod 3 is pivotally connected to the fixing joint 11, the supporting seat 51 is slidably sleeved on the supporting leg body 10, and the locking hole is arranged on the supporting leg body 10. The foot pad 12 provides a larger contact area with the ground, and rolling wheels 13 are arranged on the foot pads 12 of some of the supporting legs 1 (for example, two supporting legs 1 on the right side) to facilitate the transportation of the canopy. Unless otherwise specified, "upper end portion of the supporting leg 1" and "lower end portion of the supporting leg 1" described below refer to the fixing joint 11 and the foot pad 12, respectively.

Figure 37:
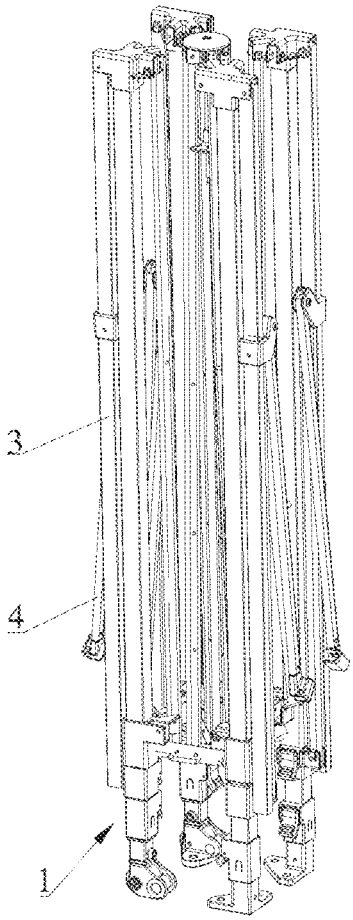
FIG. 37 is a schematic structure diagram of the canopy shown in FIG. 35 in the folded position.

In conjunction with FIG. 33 to FIG. 36, there are four supporting legs 1, and four sides, namely the front, rear, left and right sides of the canopy is provided with one outer retractable unit 21, respectively. Each outer retractable unit 21 comprises at least one eave rod assembly 210 rotatably connected between adjacent supporting legs 1, each eave rod assembly 210 comprises two eave rods 211 that can be extended and drawn close relative to each other, and the middle parts of two eave rods 211 are rotatabely connected via a third pivot shaft 212 to form a cross-shaped structure similar to scissors. The upper end portion of the supporting leg 1 (specifically, the fixing joint 11) is pivotally connected to one end portion of an eave rod 211 of the eave rod assembly 210 connected thereto; the supporting leg 1 (specifically, the supporting leg body 10) is further provided with a sliding sleeve 101, the sliding sleeve 101 is sleeved on the supporting leg 1 and capable of sliding in the up-down direction, and the sliding sleeve 101 is pivotally connected to one end portion of the other eave rod 211 of this eave rod assembly 210. When folding, the sliding sleeve 101 slides downward, and the two eave rods 211 of the eave rod assembly 210 are drawn close to each other in the transverse direction, so that the supporting legs 1 are drawn close to each other, thereby reducing the size of the canopy in the front-rear, left-right directions, as shown in FIG. 37. Specifically in this embodiment, each of the outer retractable units 21 is composed of three eave rod assemblies 210 that are rotatably connected in sequence. The clamping slot portion 41 mentioned above is preferably detachably connected to the upper end portion of the eave rod 211 which is connected to the upper end portion of the supporting leg 1, and the positioning protrusion 211*a* mentioned above is also formed at the upper portion of this eave rod 211.

Each inner retractable unit 22 comprises a first oblique top rod 222 and a second oblique top rod 221 that are rotatably connected at one end portion of each, the other end portion of the second oblique top rod 221 is rotatably connected to the upper end portion of the supporting leg 1, and the other end portion of the first oblique top rod 222 of each inner retractable unit 22 is rotatably connected to a central lock 23. The central lock 23 comprises a top cap 231 and a bottom cap 232 that can locked or disengaged from each other, and the other end portion of the first oblique top rod 222 is rotatably connected to the top cap 231; each inner retractable unit 22 further comprises an auxiliary top rod 223, one end portion of the auxiliary top rod 223 is rotatably connected to the first oblique top rod 222 and the other end portion is rotatably connected to the bottom cap 232. Each inner retractable unit 22 comprises an third oblique rod 224, the upper end portion of the third oblique rod 224 is rotatably connected to the second oblique top rod 221, and the lower end portion thereof is rotatably connected to the sliding sleeve 101 of the supporting leg 1. The central lock comprises a lock member for locking the collapsible canopy in the unfolded state when the central lock is locked and for permitting the collapsible canopy to be folded into the folded position when the central lock is unlocked; when the top cap 231 and the bottom cap 232 are locked together, the canopy frame body is locked in the unfolded position by the central lock 23; when the top cap 231 and the bottom cap 232 are unlocked, the third oblique rod 224 moves downward with the sliding sleeve 101, and pulls the inner retractable unit 22 to fold, that is, the second oblique top rod 221 and the first oblique top rod 222 rotate downward, so that the inner end portion of the second oblique top rod 221 and the outer end portion of the first oblique top rod 222 move close to the lower end portion of the supporting leg 1, the top cap 231 and the upper end portion of the supporting leg 1 are drawn close to each other, and the lower end portion of the auxiliary top rod 223, the bottom cap 232 and the outer end portion of the first oblique top rod 222 are drawn close to each other.

The canopy frame body further comprises a reinforcement mechanism 6. Specifically, the reinforcement mechanism 6 is connected between the outer retractable units 21 and the inner retractable units 22. The reinforcement mechanism 6 comprises a reinforcement bar 610, one end portion of the reinforcement bar 610 is rotatably connected to the first oblique top rod 222, and the other end portion is rotatably connected to the outer retractable units 21 (specifically, the upper rotational joint, i.e. the upper pivot shaft, of two adjacent eave rod assemblies 210). Specifically, one end portion of the reinforcement bar 610 is pivotally connected to the first oblique top rod 222, and a distance between the joint of the two and the inner end portion of the first oblique top rod 222 is less than one-third of the length of the first oblique top rod 222; the other end portion of the reinforcement bar 610 is pivotally connected to a connector 611, and the eave rods 211 of the above-mentioned two adjacent eave rod assemblies 210 are rotatably connected to this connector 611. The canopy of this embodiment has eight reinforcement bars 610, each outer retractable unit 21 is rotatably connected to the first oblique top rods 222 of two adjacent inner retractable units 22 through two reinforcement bars 610, respectively, the four groups of outer retractable units 21 and inner retractable units 22 are respectively connected together to form a reinforcement structure, so as to reduce the problem of concave deformation of the outer retractable units 21 caused by the thrust of the cross bars 4. The reinforcement bars 610 can rotate correspondingly to the unfolding and folding of the canopy frame body, without affecting the unfolding and folding of the canopy frame body.

Figure 33:
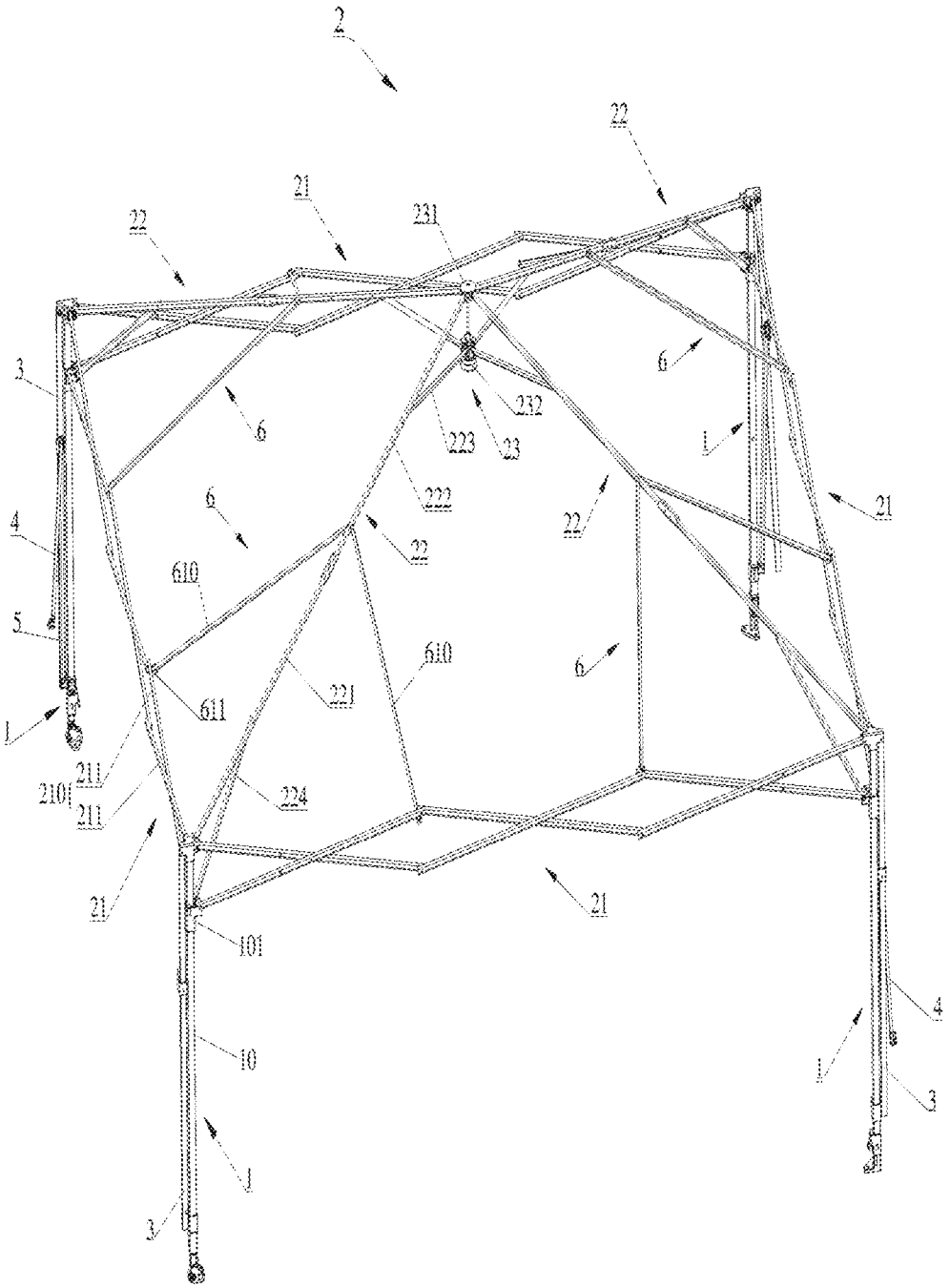
FIG. 33 shows another preferred embodiment of the present disclosure, wherein no overhanging rod is extended out.
Figure 34:
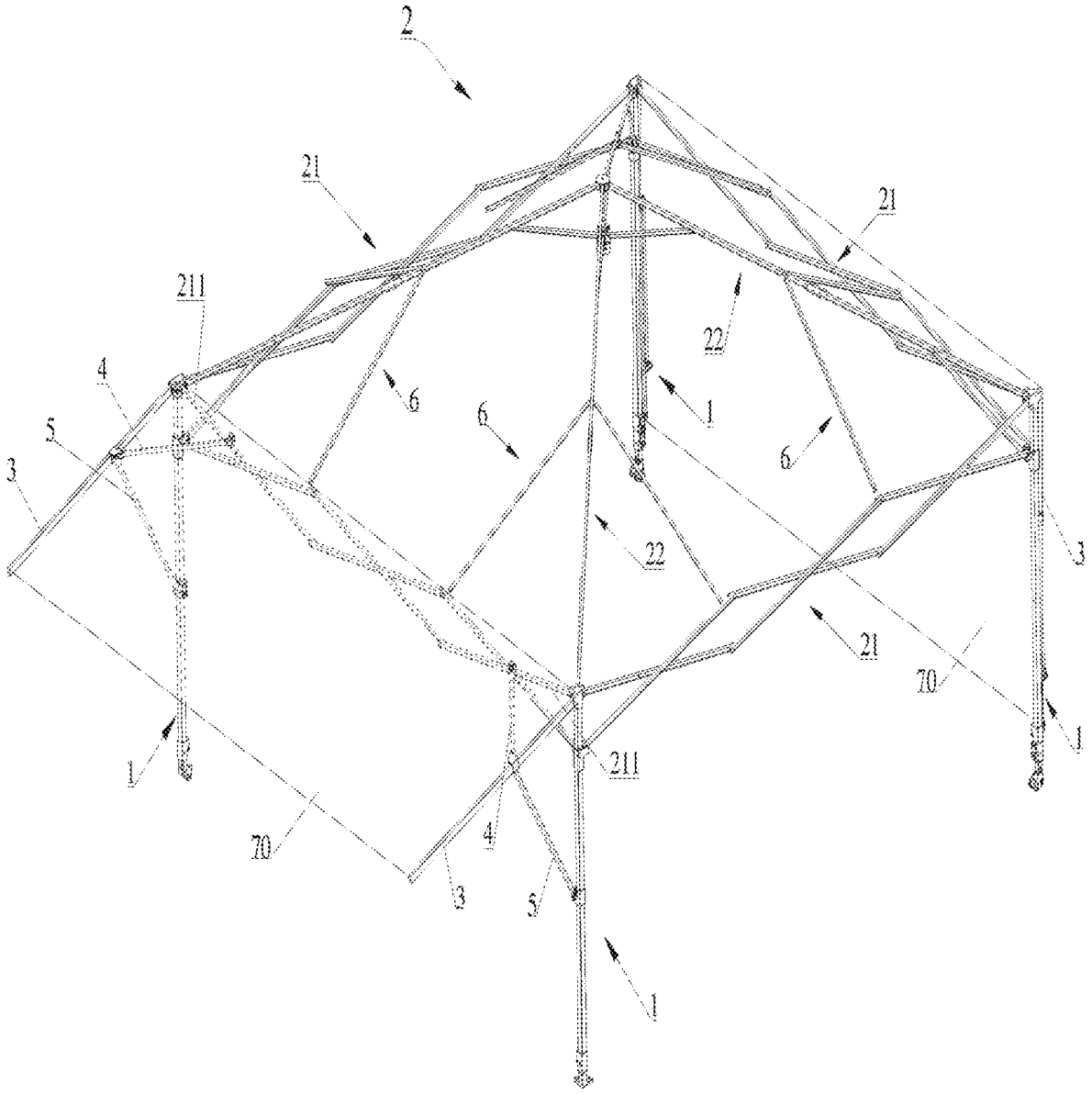
FIG. 34 is a schematic structure diagram of the canopy shown in FIG. 33 after two overhanging rods on the left side are extended out.
Figure 35:
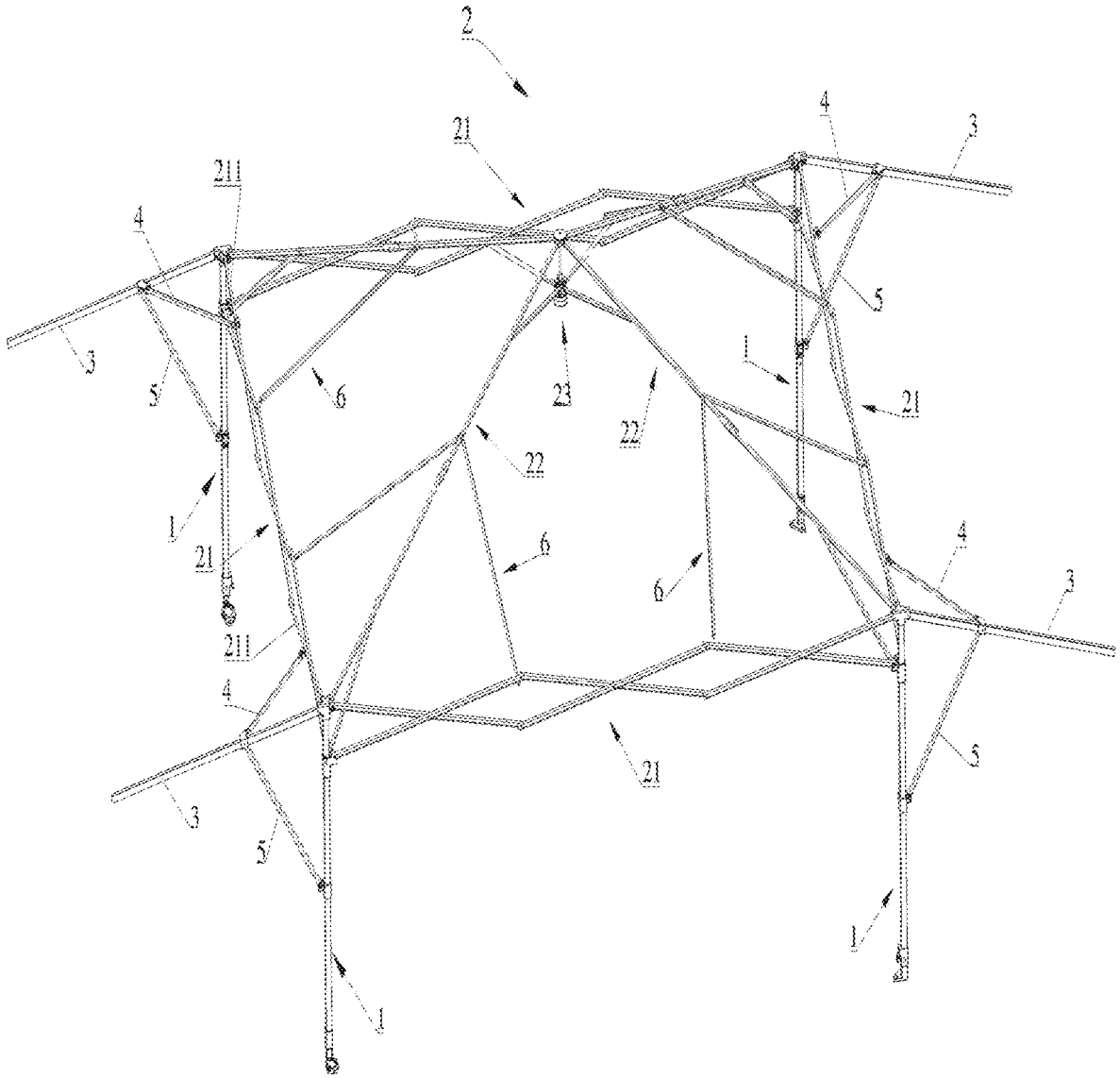
FIG. 35 is a schematic structure diagram of the canopy shown in FIG. 33 after all overhanging rods are extended out.

The canopy is used as follows: the canopy frame body is unfolded, the top cap 231 and the bottom cap 232 are then locked to each other to maintain the canopy unfold stably, as shown in FIG. 33, the overhanging rods 3 on one side are chosen to be unfolded according to the needs, as shown in FIG. 34; or the overhanging rods 3 on both sides are chosen to be unfolded, as shown in FIG. 35 and FIG. 36. The specific process of unfolding each overhanging rod 3 is as follows: the overhanging rod 3 is lifted, then the supporting seat 51 is moved upward accordingly, the second end portion of the cross bar 4 is clamped at the positioning protrusions 211*a* on the eave rods 211, and the overhanging lock mechanism is locked to lock the overhanging rods 31 stably in its unfolded state. The specific process of folding each overhanging rod 3 is as follows: the overhanging lock mechanism is unlocked, and the second end portion of the cross bar 4 is disconnected from the eave rod 211, and under the action of its own gravity, the supporting seat 51 slides downward, and the overhanging rod 3 and the cross bar 4 are hanged down automatically to the side of the supporting leg body 10. When the canopy is needed to be folded, the overhanging rod 3 can be folded in advance; if forget to fold, during the folding process of the canopy frame body, under the squeezing action of the external force, the cross bar can automatically be disconnected from the eave rod 211 to be released, specifically: the top cap 231 and the bottom cap 232 are unlocked, the sliding sleeves 101 on the supporting leg bodies 10 are moved downward, the eave rods 211 of the outer retractable units 21 are rotated and drawn close with respect to each other, in particular the eave rods 211 connected to the cross bars 4 are rotated downward, to disengage from the openings 410 of the clamping slot portions 41, and the canopy frame body is folded normally.

After the canopy is unfolded, it is possible to flexibly choose to unfold or fold the overhanging rods 3 according to the needs, and the unfolding and folding are fast and convenient; the cross bars 4 can strengthen the overhanging rods 3 after they are unfolded, which has good strength; in particular, if forget to fold the overhanging rods 3 when folding the canopy, the second end portions of the cross bars 4 can automatically disengage from the eave rods 211 of the outer retractable units 21 under the action of external force as the outer retractable units 21 are folded, which will not cause the overhanging rods 3 to be accidentally broken or the structure of the canopy frame body to be damaged due to forgetting to fold the overhanging rods 3. In addition, foldable reinforcement mechanisms 6 are provided between the outer retractable units 21 and the inner retractable units 22, which can be unfolded and folded with the canopy frame body, and can offset or reduce the thrust of the cross bars 4 on the outer retractable units 21, avoiding the problem of concave deformation of the outer retractable units 21 caused by the thrust of the cross bars 4. The canopy frame body is locked by the central lock 23, which can be quickly opened and closed.

Preferred Embodiment with Sliding Sleeves with Slots

Figure 45:
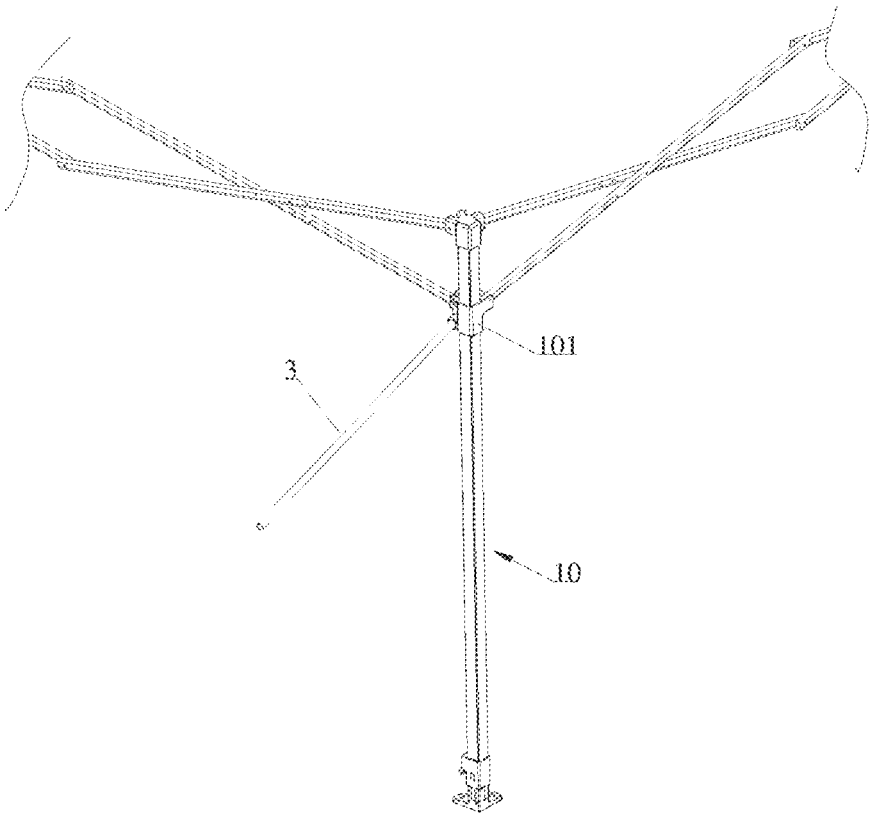
FIGS. 45-47 show yet another embodiment of the present disclosure utilizing sliding sleeves with slots.
Figure 46:
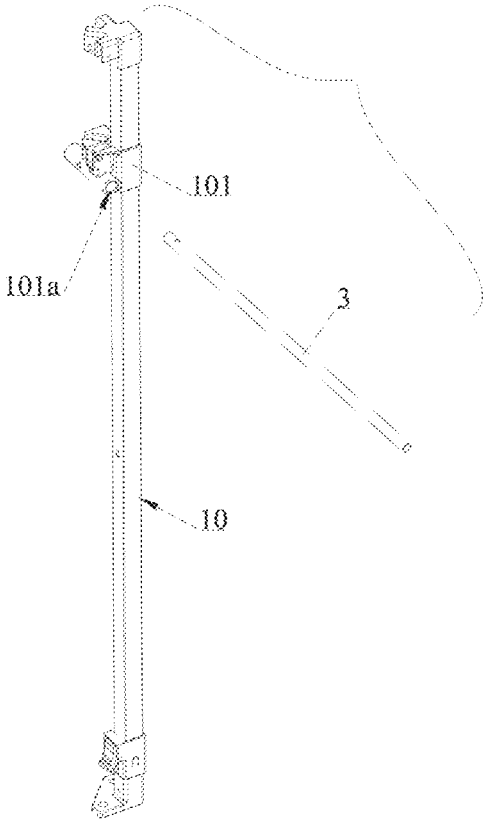
Figure 47:
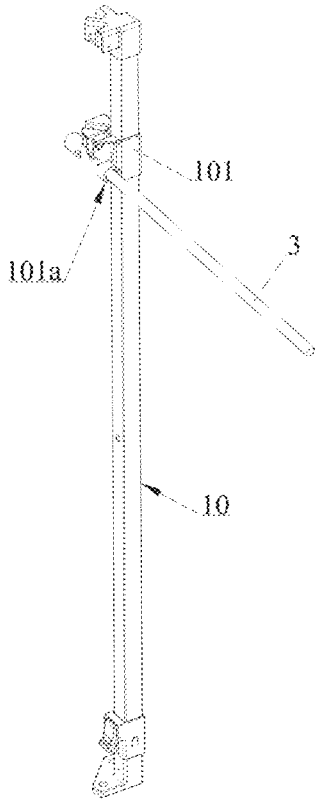

This embodiment is basically the same as the Embodiment shown in FIGS. 33-44, differs only in the connection between the overhanging rod 3 and the canopy frame body. As shown in FIGS. 45-47, each of the overhanging rods 3 is detachably inserted in one of the supporting legs 1 but not connecting to the supporting leg 1. Specifically, the inner end of each overhanging rod 3 is detachably connected to the supporting leg 1 through the sliding sleeve 101 thereon. The sliding sleeve 101 is provided with a slot 101*a*, and the slot 101*a* generally extends obliquely. When the overhanging rod 3 is in the open state, the inner end of the overhanging rod 3 is inserted in the slot 101*a* and connected with the supporting leg 1; when the overhang rod 3 is in the folded state, the inner end of the overhanging rod 3 is pull out from the slot 101*a* and detached from the supporting leg 1. Although the cross bars are not shown, the cross bars can also be automatically disconnected from the inner outer retractable units 21 when the canopy frame body is folded.

Preferred Embodiment with Fixing Joints with Slots

Figure 48:
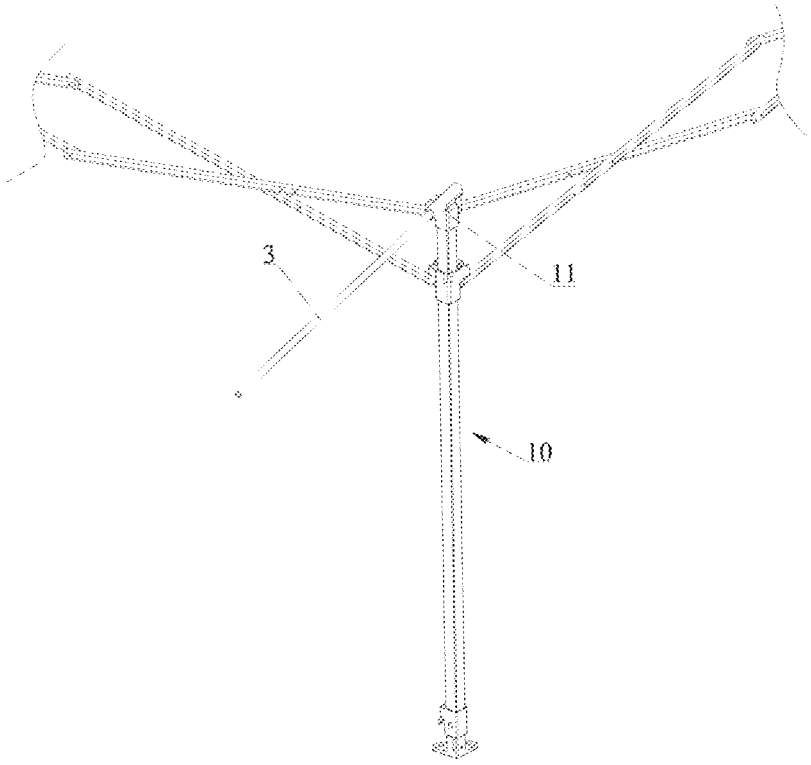
FIGS. 48-49 show yet another embodiment of the present disclosure utilizing fixing joints with slots.
Figure 49:
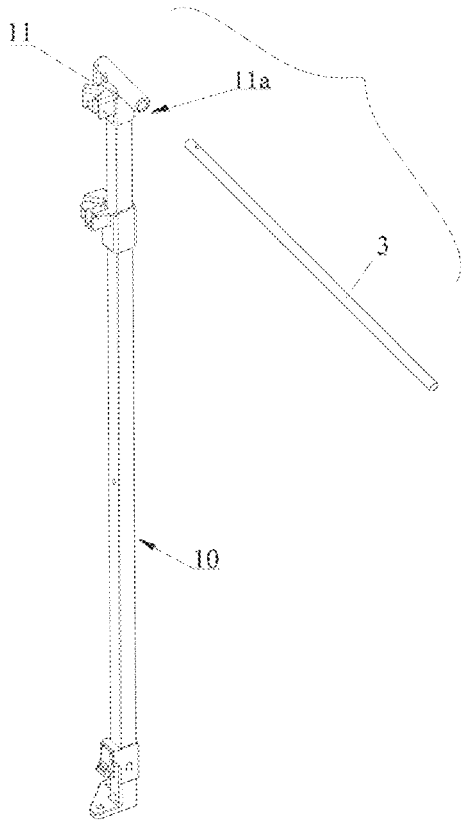

This embodiment is basically the same as the Embodiment shown in FIGS. 33-44, differs only in the connection between the overhanging rod 3 and the canopy frame body. As shown in FIGS. 48-49, each of the overhanging rods 3 is detachably inserted in one of the supporting leg 1 but not connecting to the supporting leg 1. Specifically, the inner end of each overhanging rod 3 is detachably inserted in the fixing joint 11 of one supporting leg 1. The fixing joint 11 is provided with a slot 11*a*, and the slot 11*a* generally extends obliquely. When the overhanging rod 3 is in the open state, the inner end of the overhanging rod 3 is inserted in the slot 11*a* and connected with the supporting leg 1; when the overhang rod 3 is in the folded state, the inner end of the overhanging rod 3 is pull out from the slot 11*a* and detached from the supporting leg 1. Although the cross bars are not shown, the cross bars can also be automatically disconnected from the inner outer retractable units 21 when the canopy frame body is folded.

Preferred Embodiment with Rotating Seats

Figure 50:
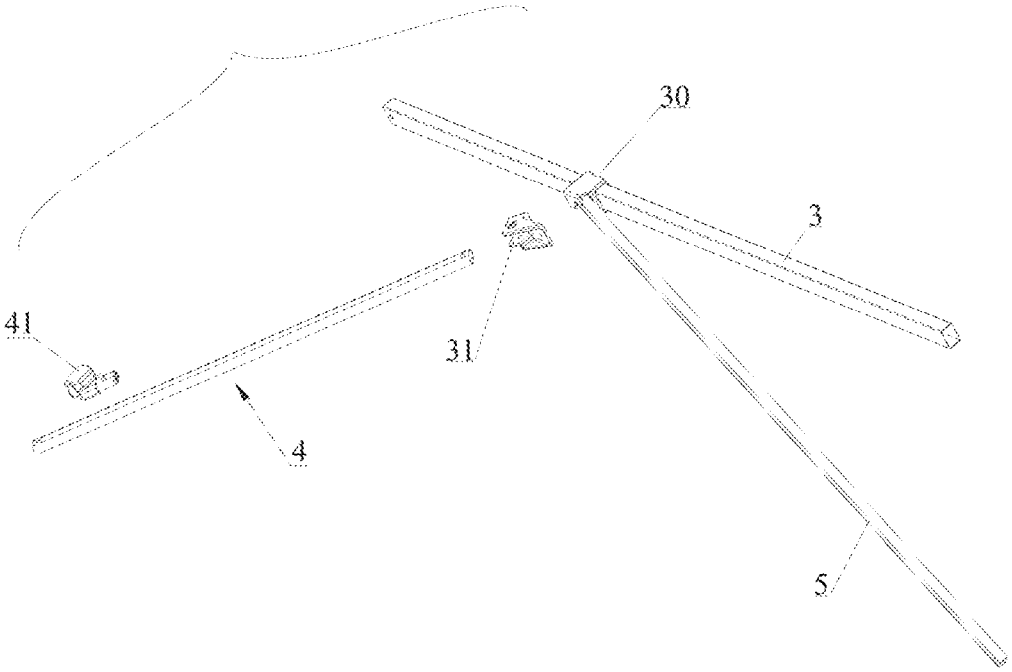
FIGS. 50-52 show yet another embodiment of the present disclosure utilizing a fixing seat and a rotating seat to rotatably connect the overhanging rod and the cross bar.
Figure 51:
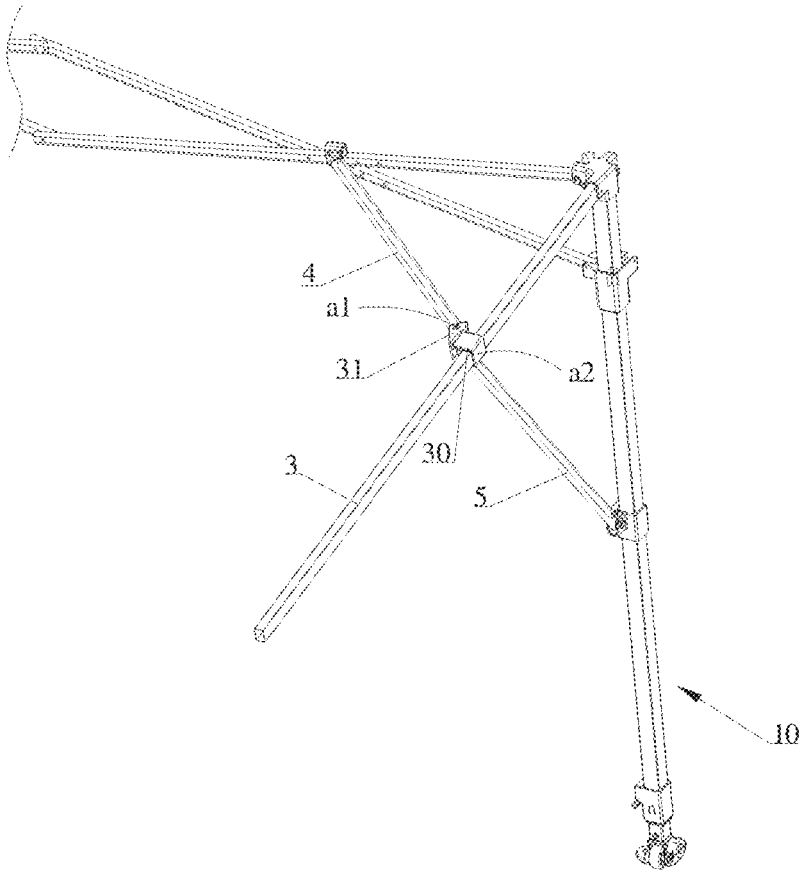
Figure 52:
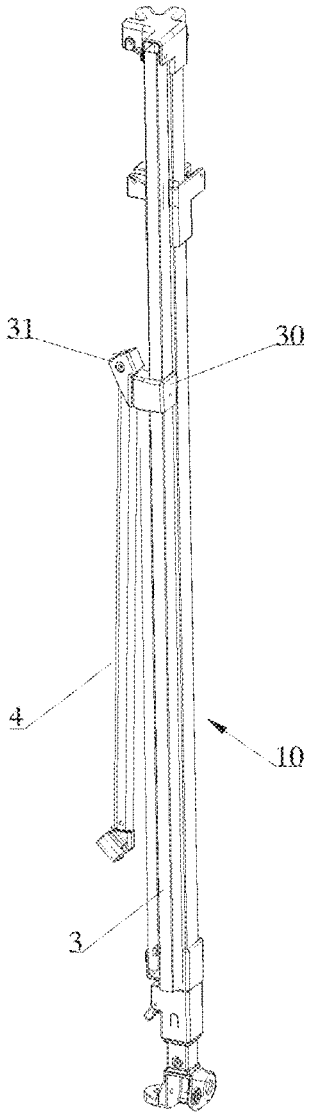

This embodiment is basically the same as the Embodiment shown in FIGS. 33-44, differs only in the connections of the overhanging rod 3, the cross bar 4 and the supporting rod 5. As shown in FIGS. 50-52, the fixing seat 30 on each of the overhanging rods 3 is rotatably connected to a rotating seat 31, the first end portion of one of the cross bars 4 is rotatably connected with the rotating seat 31 via a pivot shaft a1, and the second end portion of the supporting rod 5 is rotatably connected with the fixing seat 30 via a pivot shaft a2. In particular, the rotating seat 31, the fixing seat 30 and the second end portion of the supporting rod 5 are rotatably connected via the pivot shaft a2. When the overhanging rod 3 is in the folded state, the lower end portion of the overhang rod 3, the second end portion of the cross bar 4, and the first end portion of the support rod 5 and the supporting leg 1 are close to each other.

Preferred Embodiment with Rotating Joints

Figure 53:
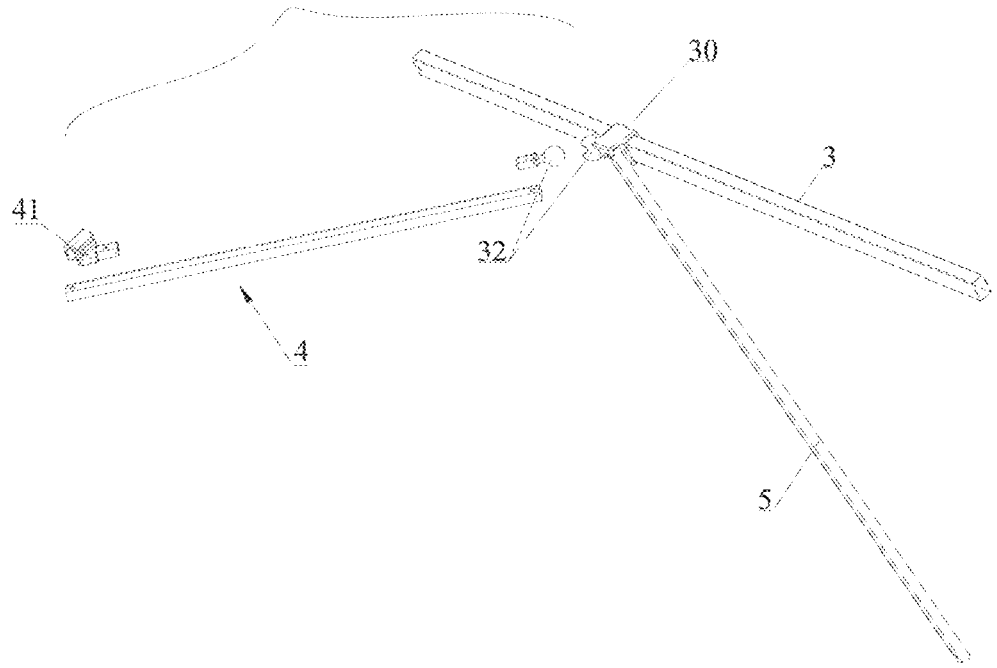
FIGS. 53-55 show yet another embodiment of the present disclosure utilizing a fixing seat and a rotating joint to rotatably connect the overhanging rod and the cross bar.
Figure 54:
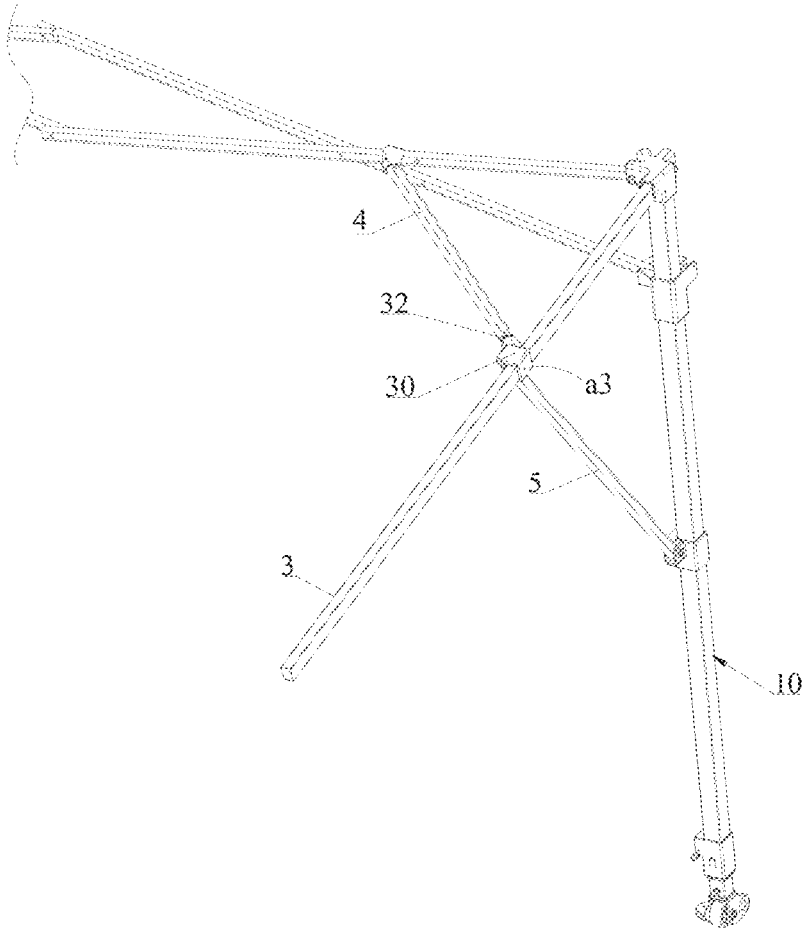
Figure 55:
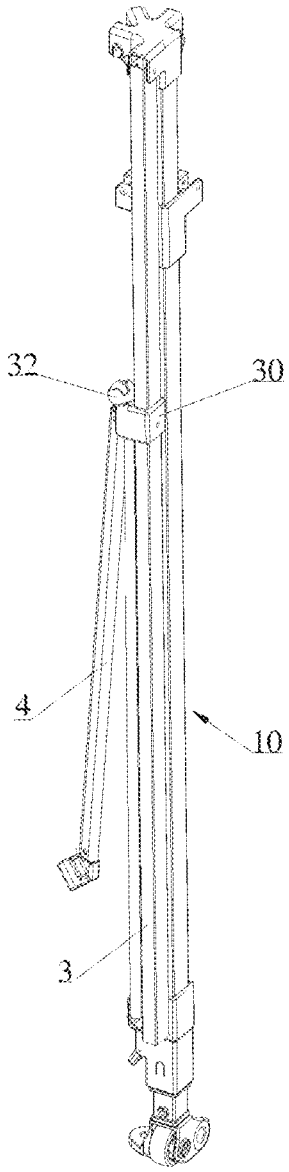

This embodiment is basically the same as the Embodiment shown in FIGS. 33-44, differs only in the connections of the overhanging rod 3, the cross bar 4 and the supporting rod 5. As shown in FIGS. 53-55, the first end portion of one of the cross bars 4 is rotatably connected with the fixing seat 30 on each of the overhanging rods 3 via a rotating joint 32, and the second end portion of the supporting rod 5 is rotatably connected with the fixing seat 30 via a pivot shaft a3. When the overhanging rod 3 is in the folded state, the lower end portion of the overhang rod 3, the second end portion of the cross bar 4, and the first end portion of the support rod 5 and the supporting leg 1 are close to each other.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

We claim:

1. A collapsible canopy, comprising:

at least three supporting legs, a plurality of outer retractable units, each outer retractable unit connected between two of the at least three supporting legs;

a plurality of inner retractable units, each inner retractable unit connected to one of the at least three supporting legs, wherein the plurality of outer retractable units and the plurality of inner retractable units form a roof frame of the collapsible canopy;

a plurality of reinforcement bars, wherein each reinforcement bar is respectively connected between an outer retractable unit of the plurality of outer retractable units and an inner retractable unit of the plurality of inner retractable units, and the plurality of reinforcement bars function to reduce flex of the plurality of outer retractable units and the plurality of inner retractable units when the collapsible canopy is in a locked and unfolded position; and a plurality of overhanging rods, each overhanging rod has an unfolded state and a folded state when the collapsible canopy is in an unfolded position, wherein, when one overhanging rod of the plurality of overhanging rods is in the unfolded state, an inner end portion of the one overhanging rod is connected to a supporting leg of the at least three supporting legs, an outer end portion of the one overhanging rod is offset from the respective supporting leg by a distance, and the one overhanging rod is transverse to the respective supporting leg to support a surrounding cloth, and, when the one overhanging rod is in the folded state, the surrounding cloth hangs down to a side of the respective supporting leg; and a plurality of cross bars, each cross bar has two end portions for connecting one of the plurality of outer retractable units and one of the plurality of overhanging rods, respectively, such that the one overhanging rod is reinforced when the one overhanging rod is in the unfolded state.

2. The collapsible canopy as in claim 1, wherein one cross bar has a first end portion for rotatably connecting to the one overhanging rod of the plurality of overhanging rods and a second end portion for detachably connecting to one of the plurality of outer retractable units; when the one overhanging rod is in the folded state, the second end portion of the one cross bar of the plurality of cross bars is disconnected from the outer retractable unit, and the outer end portion of the one overhanging rod is drawn close to the respective supporting leg; when the one overhanging rod is in the unfolded state, the second end portion of the one cross bar is connected to the outer retractable unit, and the outer end portion of the one overhanging rod is offset from the respective supporting leg by a distance; during folding the collapsible canopy from the unfolded position to a folded position, the second end portion of the cross bar is disconnected from the outer retractable unit, and the one overhanging rod is converted from the unfolded state to the folded state.

3. The collapsible canopy as in claim 2, wherein the inner end portion of the one overhanging rod is rotatably connected to the respective supporting leg, the collapsible canopy further comprises a plurality of supporting rods each having a first end portion and a second end portion, each first end portion is rotatably and slidably connected to one of the plurality of supporting legs and capable of sliding in an up-down direction, and the second end portion is rotatably connected to one of the plurality of overhanging rods.

4. The collapsible canopy as in claim 3, wherein the first end portion of each of the plurality of supporting rods is rotatably connected to a supporting seat, and the supporting seat is slidably connected to one of the plurality of supporting legs and capable of sliding in the up-down direction.

5. The collapsible canopy as in claim 3, wherein a fixing seat is arranged between the inner end portion and the outer end portion of the one overhanging rod, the first end portion of the one cross bar is rotatably connected to the fixing seat via a first pivot shaft, the second end portion of one supporting rod is rotatably connected to the fixing seat via a second pivot shaft, and when the one overhanging rod is in the folded state, an angle formed between axial line of the first pivot shaft and/or the second pivot shaft and a horizontal plane is less than 10 degrees.

6. The collapsible canopy as in claim 3, wherein, when the one overhanging rod is in the folded state, the outer end portion of the one overhanging rod, the first end portion of a supporting rod, and a lower end portion of the respective supporting leg are drawn close to each other.

7. The collapsible canopy as in claim 2, wherein the outer retractable unit comprises an eave pipe capable of turning downward when the collapsible canopy is folded, and a clamping slot portion capable of accommodating the eave pipe is formed on the second end portion of a cross bar.

8. The collapsible canopy as in claim 7, wherein the clamping slot portion has an opening facing downward.

9. The collapsible canopy as in claim 7, wherein a positioning protrusion is formed on the eave pipe, and the clamping slot portion has a positioning groove matched with the positioning protrusion.

10. The collapsible canopy as in claim 7, wherein a cross bar of the plurality of cross bars is forced by the one overhanging rod to be automatically disconnected from the eave pipe during folding the collapsible canopy from the unfolded position to the folded position.

11. The collapsible canopy as in claim 1, wherein each of the plurality of reinforcement bars are pivotally connected between one of the plurality of outer retractable units and one of the plurality of inner retractable units, respectively.

12. The collapsible canopy as in claim 11, wherein the collapsible canopy further comprises a central lock comprising a lock member for locking the collapsible canopy in the unfolded state when the central lock is locked and for permitting the collapsible canopy to be folded into the folded state when the central lock is unlocked, wherein inner ends of the plurality of inner retractable units are connected to the central lock; each inner retractable unit comprises at least one first oblique top rod pivotally connected to the central lock, each inner retractable unit comprises at least one eave rod, and each of the plurality of reinforcement bars is pivotally connected between the first oblique top rod and the at least one eave rod.

13. The collapsible canopy as in claim 12, wherein the outer retractable unit comprises at least one middle eave pipe, wherein each of the plurality of reinforcement bars is pivotally connected between the at least one first oblique top pipe and the at least one middle eave pipe.

14. The collapsible canopy as in claim 12, wherein the central lock is a self-locking central lock comprising:

A. a center top cap,

B. a bottom cap,

C. at least two top pipes pivotally connected to the central top cap, and

D. at least two connecting rods, each one pivotally connected at a top pipe pivot axis to one of the at least two top pipes, and each one pivotally connected to the bottom cap at a bottom cap pivot axis, wherein the self-locking central lock is placed in a locked position by upward movement of the bottom cap and the at least two connecting rods, wherein as the bottom cap is pushed upward the self-locking central lock moves to a locking position when: i. the bottom cap pivot axis is pressed higher than the top pipe pivot axis, and ii. the upward movement of the bottom cap and the at least two connecting rods is stopped by a stopping device.

15. The collapsible canopy as in claim 1, wherein each of the plurality of reinforcement bars is a single bar.

16. The collapsible canopy as in claim 1, wherein each of the plurality of overhanging rods is detachably inserted in one of the plurality of supporting legs, when the overhanging rod is in the folded state, the inner end portion of the one overhanging rod is detached from the supporting leg; when the one overhanging rod is in the unfolded state, the inner end portion of the one overhanging rod is inserted in the supporting leg.

17. The collapsible canopy as in claim 1, wherein each of the plurality of overhanging rods extends along a length direction of one of the plurality of outer retractable units when the one overhanging rod is in the unfolded state.

* * * * *